US009156051B2

(12) United States Patent
Cai et al.

(10) Patent No.: US 9,156,051 B2
(45) **Date of Patent: *Oct. 13, 2015**

(54) HAND HELD SHOWER HEAD WITH FILTER REPLACING PRE-ALARM DEVICE

(71) Applicants: Ying Lin Cai, Guangdong (CN); Chao Fou Hsu, Kaohsiung (TW)

(72) Inventors: Ying Lin Cai, Guangdong (CN); Chao Fou Hsu, Kaohsiung (TW)

( * ) Notice: Subject to any disclaimer, the term of this patent is extended or adjusted under 35 U.S.C. 154(b) by 335 days.

This patent is subject to a terminal disclaimer.

(21) Appl. No.: 13/729,063

(22) Filed: Dec. 28, 2012

(65) Prior Publication Data

US 2014/0042240 A1 Feb. 13, 2014

Related U.S. Application Data

(60) Provisional application No. 61/681,221, filed on Aug. 9, 2012.

(51) Int. Cl.

| | |
|---|---|
| ***B67D 7/08*** | (2010.01) |
| ***B67D 7/56*** | (2010.01) |
| ***B05B 15/06*** | (2006.01) |
| ***B05B 7/12*** | (2006.01) |
| ***A62C 31/00*** | (2006.01) |
| ***B05B 1/30*** | (2006.01) |
| ***B05B 15/00*** | (2006.01) |
| ***B05B 1/18*** | (2006.01) |

(52) U.S. Cl.

CPC ..... *B05B 15/008* (2013.01); *B05B 1/18* (2013.01)

(58) Field of Classification Search

CPC ..... B05B 1/18; B05B 15/008

USPC ..... 239/71–74, 283, 588, 390, 407, 569, 239/446–449; 210/85, 87

See application file for complete search history.

(56) References Cited

U.S. PATENT DOCUMENTS

| | | | | |
|---|---|---|---|---|
| 4,107,046 | A * | 8/1978 | Corder | 210/282 |
| 5,160,197 | A | 11/1992 | Klose | |
| 5,540,107 | A * | 7/1996 | Silverman et al. | 73/861.78 |
| 5,858,215 | A * | 1/1999 | Burchard et al. | 210/87 |
| 6,016,977 | A * | 1/2000 | Farley | 239/553.3 |
| 6,093,313 | A * | 7/2000 | Bovaird et al. | 210/94 |
| 6,270,023 | B1 * | 8/2001 | Farley | 239/553.3 |
| 6,641,717 | B2 * | 11/2003 | Okano et al. | 210/87 |
| 6,892,952 | B2 | 5/2005 | Chang et al. | |
| 6,927,501 | B2 * | 8/2005 | Baarman et al. | 290/43 |
| 7,468,127 | B2 * | 12/2008 | Hsu | 210/87 |
| 8,162,236 | B2 * | 4/2012 | Rodenbeck et al. | 239/390 |
| 2003/0125842 | A1 * | 7/2003 | Chang et al. | 700/282 |

* cited by examiner

*Primary Examiner* — Jason Boeckmann
*Assistant Examiner* — Steven M Cernoch
(74) *Attorney, Agent, or Firm* — Bacon & Thomas, PLLC

(57) ABSTRACT

The present invention provides a hand held shower head with filter replacing pre-alarm device, which comprises a round recess socket containing a detachable alerting pod is created in the reverse side of a shower head shell. A signal circuit device is embedded in the alerting pod for measuring and displaying function. The alerting pod can be either inserted into the recess socket for normal measuring and alerting function or detached off the recess socket for battery recharging operation. Thereby, not only the shower head shell can be adequately powered but also the alerting pod can be separated out of the shower head shell for independently recharging operation so that the entire shower head shell is unnecessary to discarded and replaced even the DC power supply in the signal circuit device is running out. Thus, it not only saves resource waste but also conserves economical expense incurred by frequent replacement of the shower head.

11 Claims, 26 Drawing Sheets

HAND HELD SHOWER HEAD WITH FILTER REPLACING PRE-ALARM DEVICE

This application claims the benefit of provisional U.S. Patent Application No. 61/681,221, filed Aug. 9, 2012, and incorporated herein by reference.

FIELD OF THE PRESENT INVENTION

The present invention relates to a hand held shower head with filter replacing pre-alarm device in pertaining to innovative application for the shower head, particularly for one that a round recess socket is created in the reverse side of the shower head shell, and a detachable alerting pod with an internal signal circuit device is independently created so that the alerting pod can be either inserted into the recess socket for normal measuring and alerting function or detached off the recess socket for battery recharging operation. Thereby, not only the shower head shell can be adequately powered but also the alerting function can be accurately maintained.

BACKGROUND OF THE INVENTION

The present applicant innovatively invented a "hand held shower head with filter replacing pre-alarm device" having been already granted an U.S. invent patent in number of U.S. Pat. No. 7,468,127, a mainland China invent patent in number of 584889, a British invent patent in number of GB 2435797 and a Korea invent patent in number of 10-0912738, which are on the record. As shown in FIGS. 1 to 3, the structure of the "hand held shower head with filter replacing pre-alarm device" comprises a shower head 10, a base seat 20, a cover seat 30, a propeller wheel 40 and a signal circuit device 50 such that the base seat 20, the cover seat 30 and the propeller wheel 40 are totally imbedded and affixed in the inner of the shower head 10, wherein:

said shower head 10 has a hollow body and a water inlet 11, which is having screw threads 12 formed thereon, and provided to connect with a filter hand hold 60, in front of the shower head 10 has firmly mounted a cover member 12 by means of a screw 121, and said cover member 12 has a plurality of spray holes 122 to allow the water spray out of the shower head 10, to the rear of the shower head 10 is tightly affixed a LCD display circuit 56, is used in displaying an instruction sent by the microprocessor 51 of the signal circuit device 50 (as shown in FIG. 3);

said base seat 20 has an indented water chamber 21 formed at the bottom surface of, a water inlet channel 22 and an outlet channel 23 are formed at the two sides of the water chamber 21 respectively to be communicable with each other, and a rotation axle 24 downwardly protruded from central area of a top surface of the water chamber 21 of the base seat 20;

said cover seat 30, which is tightly affixed on the bottom side of the base seat 20 with the bottom surface of the base seat 20 abutting to a top surface of the cover seat 30, has a water inlet 31 formed on a side surface of the cover seat 30 with two ends thereof being corresponding to the inlet channel 22 and the water inlet 11 respectively, a water outlet 32, which is corresponding to the outlet channel 23 and is formed on a top surface of the cover seat 30, a supporting axle 33 is upwardly protruded from a central area of a top side of the cover seat 30, and a threaded hole 341 of central dowel 34 downwardly protruded the opposite side.

said propeller wheel 40, which is a circular body with a plurality of curved propeller blades are extended radically from the circular body to be situated and supported in the water chamber 21 of the base seat 20 in rotatable manner, has two central axial recesses 41 coaxially created at a center of top side and a bottom side of the propeller wheel 40 respectively, a magnetic element 42 embedded on a top side of the propeller wheel 40 so that the rotation axle 24 and the supporting axle 33 are fitted into the two central axial recesses 41 located in the center of the water chamber 21 of the base seat 20 (as shown in FIG. 1); and said signal circuit device 50 comprises a microprocessor 51, a DC power supply 52 electrically connected to the microprocessor 51, a transducer 53 electrically connected to the microprocessor 51, a reset switch 54 electrically connected to the microprocessor 51, a re-start (rest) switch 55 electrically connected to the microprocessor 51, a LCD display circuit 56 electrically connected to the microprocessor 51, a buzzer 57 electrically connected to the microprocessor 51 and a signal receiver 58, which is closed at the top surface of base seat 20 and corresponding to the magnetic element 42 (as shown in FIG. 1).

The foregoing base seat 20, the cover seat 30 and the propeller wheel 40 are assembled by means of the screws 14 and affixed to the inner of the shower head 10, so that the water inlet 31, the inlet channel 22, the water chamber 21, the outlet 23 and the water outlet 32 define a water flowing passage.

Please refer to FIGS. 1 and 3. In accordance with an operating mode of the present invention, a water supply pipe is connected to the filter handhold 60. Water flow enters the water chamber 21 through the water inlet 31 and inlet channel 22, forcing the propeller wheel 40 to rotate, and flows out through the outlet channel 23, the water outlet 32 and the spray holes 122 of the cover member 12. When the propeller wheel 40 rotates, the magnetic element 42 induces the signal receiver 58 of the signal circuit device 50, so that the signal receiver 58 receives a sensor signal and transmit to the microprocessor 51 via the transducer 53. Such continuous signals are transmitted to the microprocessor 51 and will process sending corresponding signals to the LCD display circuit 56, an accurate quantity of flow can be calculated according to the equation:

$$\text{Quantity of Flow}(Q)=\text{Cross Sectional Area}(A)\text{ times Flow Velocity}(V)$$

Thereby, a user can easily obtain a total statistical volume of water flowing through the filter handhold 60, simply by looking at the LCD display circuit 56.

The total water reading value, that is a total volume of flowing water made by the filtration element 62 of the filter handhold 60, is formatted and input into the microprocessor 51 as a predetermined reference value which is a digital standard reference value showing the service life (critical point) of the respective filtration element. When the total flowing volume value reach to the service life of the filter handhold 60, the microprocessor 51 will sending a signal to the buzzer 57 for advancing a warning alarm to notify that it is the time for the user to replace a new filtration element of the filter handhold 60. Therefore, the user can avoid in consequence of missing replacement timing and still continuously using the malfunctioned filter.

After practical test of the foregoing conventional "hand held shower head with filter replacing pre-alarm device" for a certain period, two issues are emerged though it can achieves the expected effects. The issues are that the power source of the DC power supply 52 in the signal circuit device 50 will gradually run out to disable the measuring and displaying functions; and the DC power supply 52 in the signal circuit device 50 can not be independently replaced because the LCD display circuit 56 is integrated with the shower head 10 as unitary entity so that the DC power supply 52 together with the shower head 10 must be discarded and replaced once the power source of the DC power supply 52 runs out. Thus, it not only causes resource waste but also increase economical expense incurred by frequent replacement of the shower head. Consequently, it becomes a marketing disadvantage due to reluctance in continuously usage of the conventional "hand held shower head with filter replacing pre-alarm device". Having further researched and studied in painstaking manner by addressing the issues mentioned above, the present inventor eventually works out the present invention by overcoming the issues mentioned above.

SUMMARY OF THE INVENTION

The primary object of the present invention is to provide a "hand held shower head with filter replacing pre-alarm device" which originates a novel contrivance that the a round recess socket is created in the reverse side of the shower head shell, and a detachable alerting pod with an internal signal circuit device is independently created so that the alerting pod can be either inserted into the recess socket in the reverse side of the shower head shell for normal measuring and alerting function or detached off the recess socket for battery recharging operation. Thereby, not only the shower head shell can be adequately powered but also the alerting pod can be separated out of the shower head shell for recharging operation in isolated manner.

The other object of the present invention is to provide a "hand held shower head with filter replacing pre-alarm device" which comprises a shower head shell, an internal lid, an impeller, a hood and a detachable alerting pod, wherein a recess socket with a alerting pod embedded therein is created in the reverse side of the shower head shell, and a signal circuit device is independently created in the detachable alerting pod. Accordingly, the alerting pod can be either inserted into a recess socket in the reverse side of the shower head shell for normal measuring and alerting function or detached off the recess socket or battery recharging operation. Thereby, not only the shower head shell can be adequately powered but also the alerting pod can be separated out of the shower head shell for recharging operation in isolated manner so that the entire shower head shell is unnecessary to discarded and replaced even the DC power supply in the signal circuit device is running out. Thus, it not only saves resource waste but also conserves economical expense incurred by frequent replacement of the shower head. Consequently, it becomes a marketing advantage due to enhance the desire in continuously using the present invention.

DETAILED DESCRIPTION OF THE PREFERRED EMBODIMENTS

Figure 1:
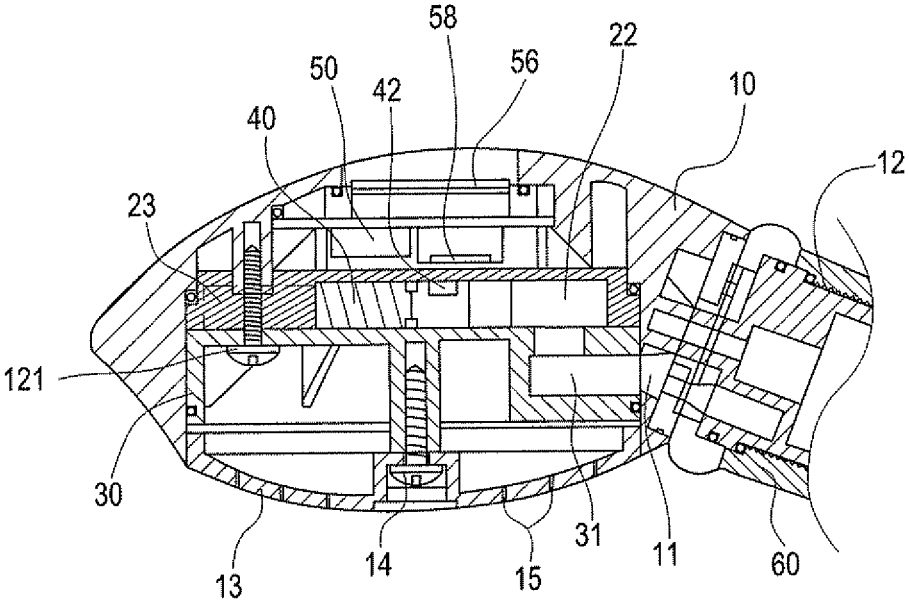
Fig.1 (Prior Art)
FIG. 1 is an assembled cross sectional view for the conventional hand held shower head with filter replacing pre-alarm device.
Figure 2:
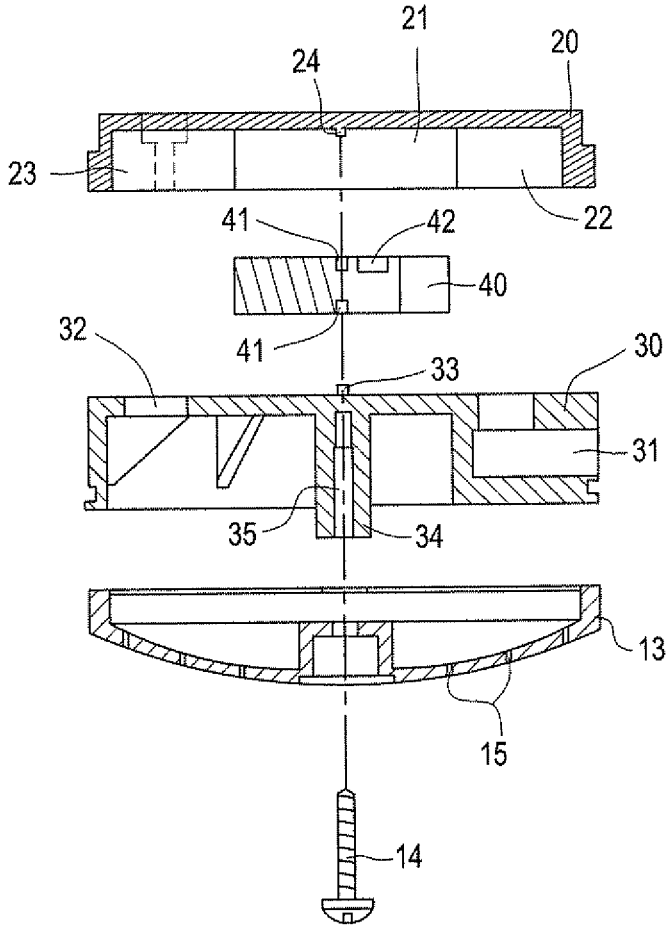
Fig.2 (Prior Art)
FIG. 2 is an exploded perspective schematic view for the conventional hand held shower head with filter replacing pre-alarm device.
Figure 3:
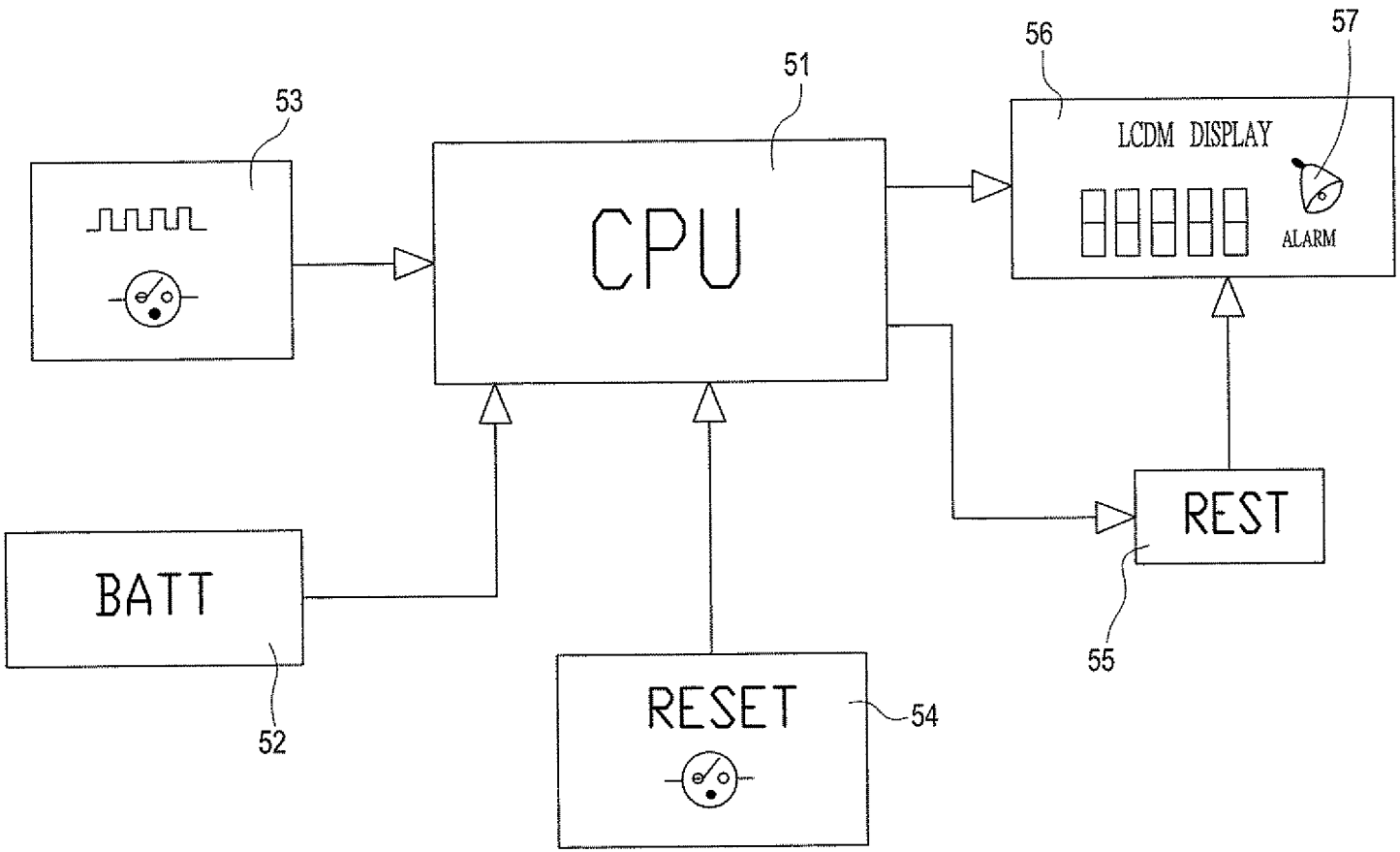
Fig.3 (Prior Art)
FIG. 3 is an electrical block diagram for the conventional hand held shower head with filter replacing pre-alarm device.
Figure 4:
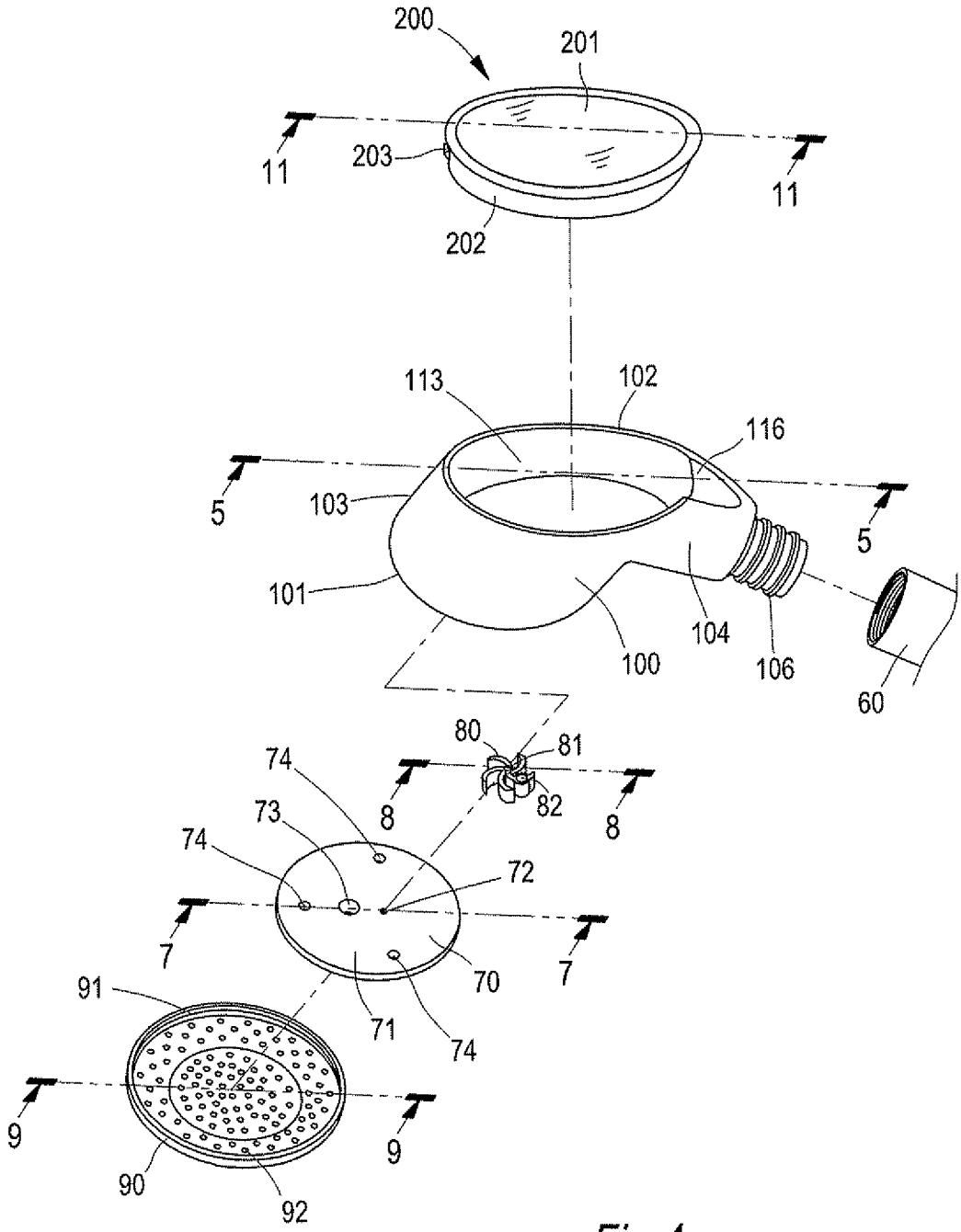
FIG. 4 is an exploded perspective schematic view for a hand held shower head with filter replacing pre-alarm device in the first preferred exemplary embodiment of the present invention.
Figure 5:
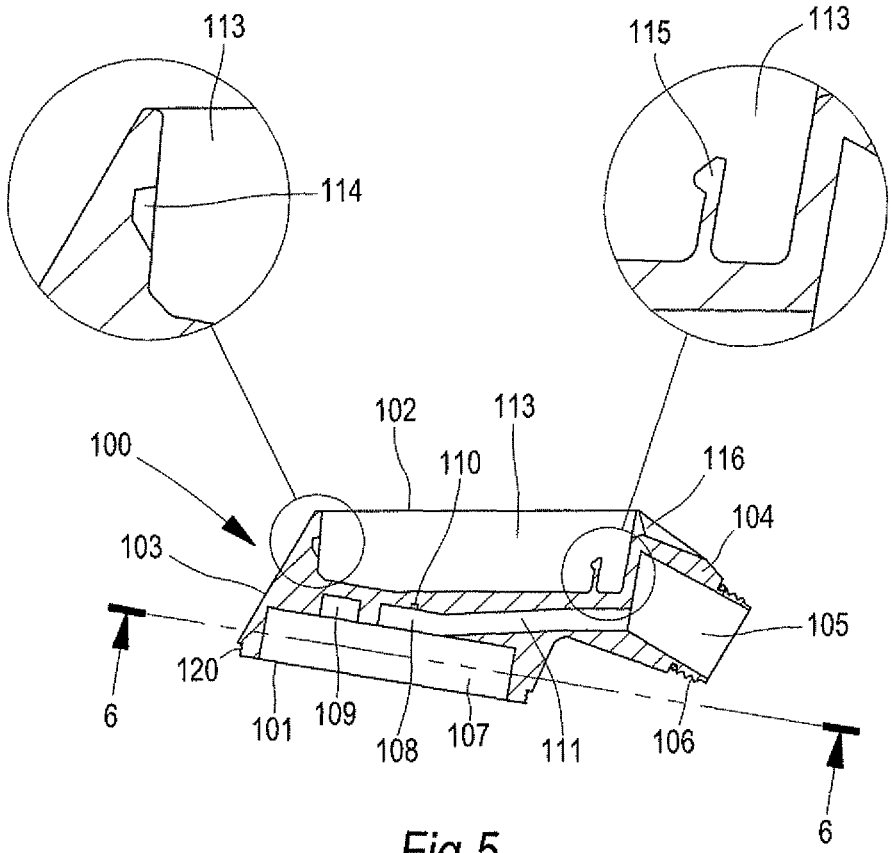
FIG. 5 is a cross sectional view taken from the 5-5 section line of previous FIG. 4.
Figure 6:
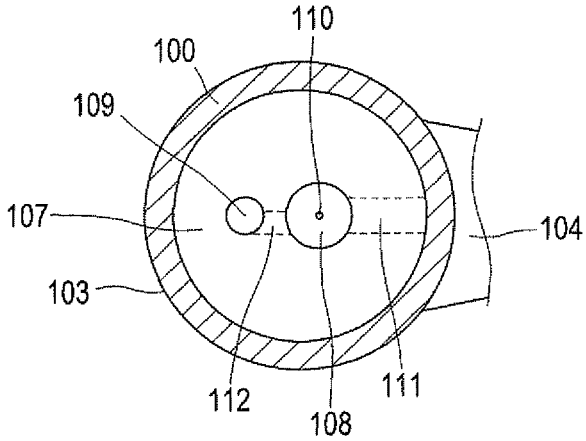
FIG. 6 is a cross sectional view taken from the 6-6 section line of previous FIG. 5.
Figure 7:
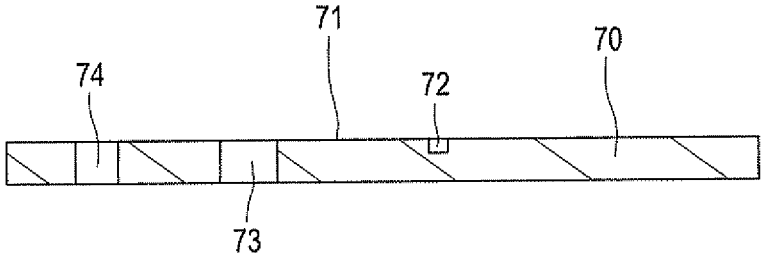
FIG. 7 is a cross sectional view taken from the 7-7 section line of previous FIG. 4.
Figure 8:
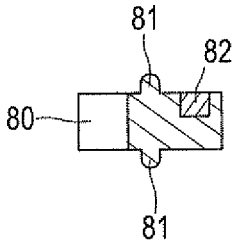
FIG. 8 is a cross sectional view taken from the 8-8 section line of previous FIG. 4.
Figure 9:
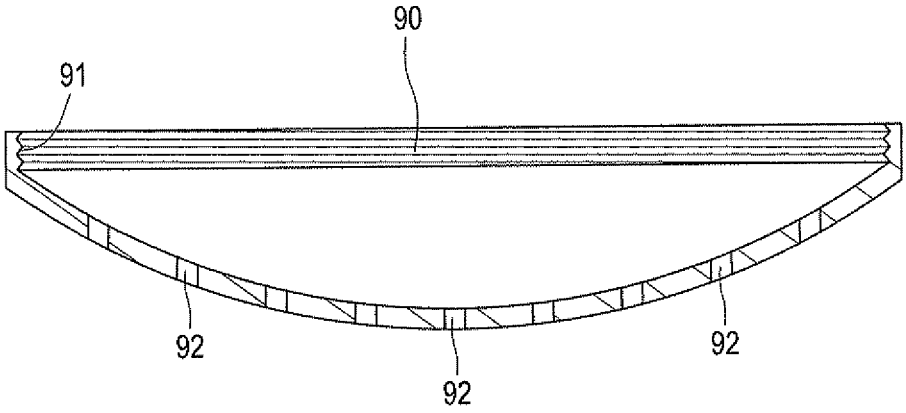
FIG. 9 is a cross sectional view taken from the 9-9 section line of previous FIG. 4.
Figure 10:
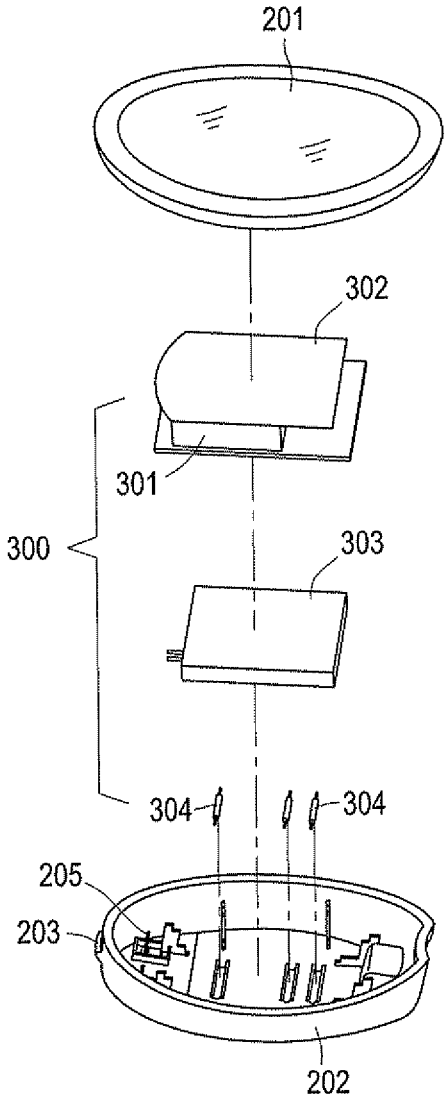
FIG. 10 is an exploded perspective schematic view for showing an alerting pod in the first preferred exemplary embodiment of the present invention.
Figure 11:
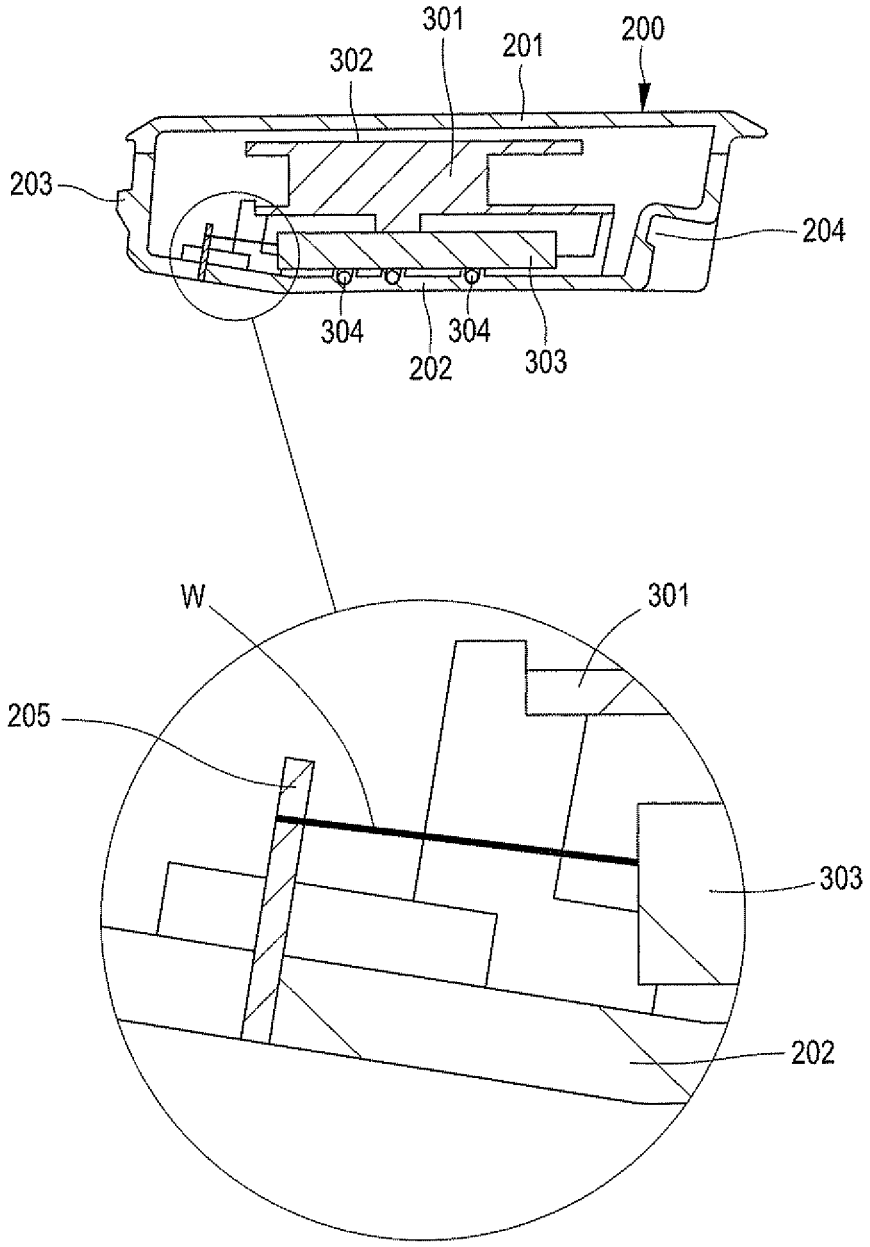
FIG. 11 is a cross sectional view taken from the 11-11 section line of previous FIG. 4.
Figure 14:
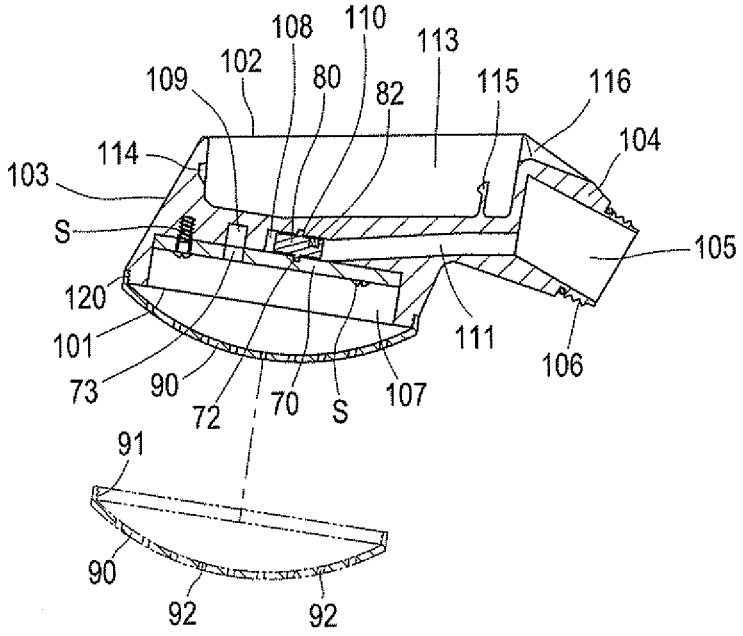
FIG. 14 is the third assembly view for a hand held shower head with filter replacing pre-alarm device in the first preferred exemplary embodiment of the present invention.
Figure 20:
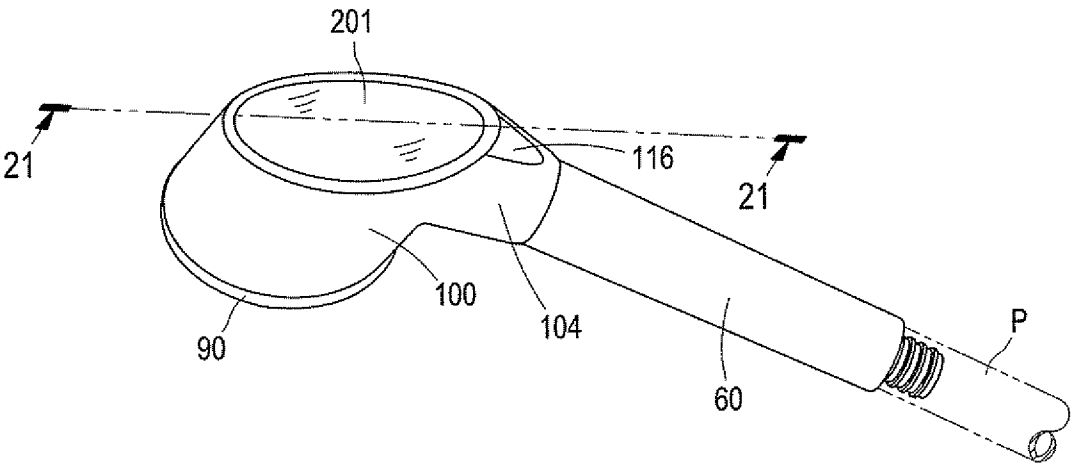
FIG. 20 is a perspective schematic view for showing assembles of a handle filter with a shower head shell in the first preferred exemplary embodiment of the present invention.
Figure 21:
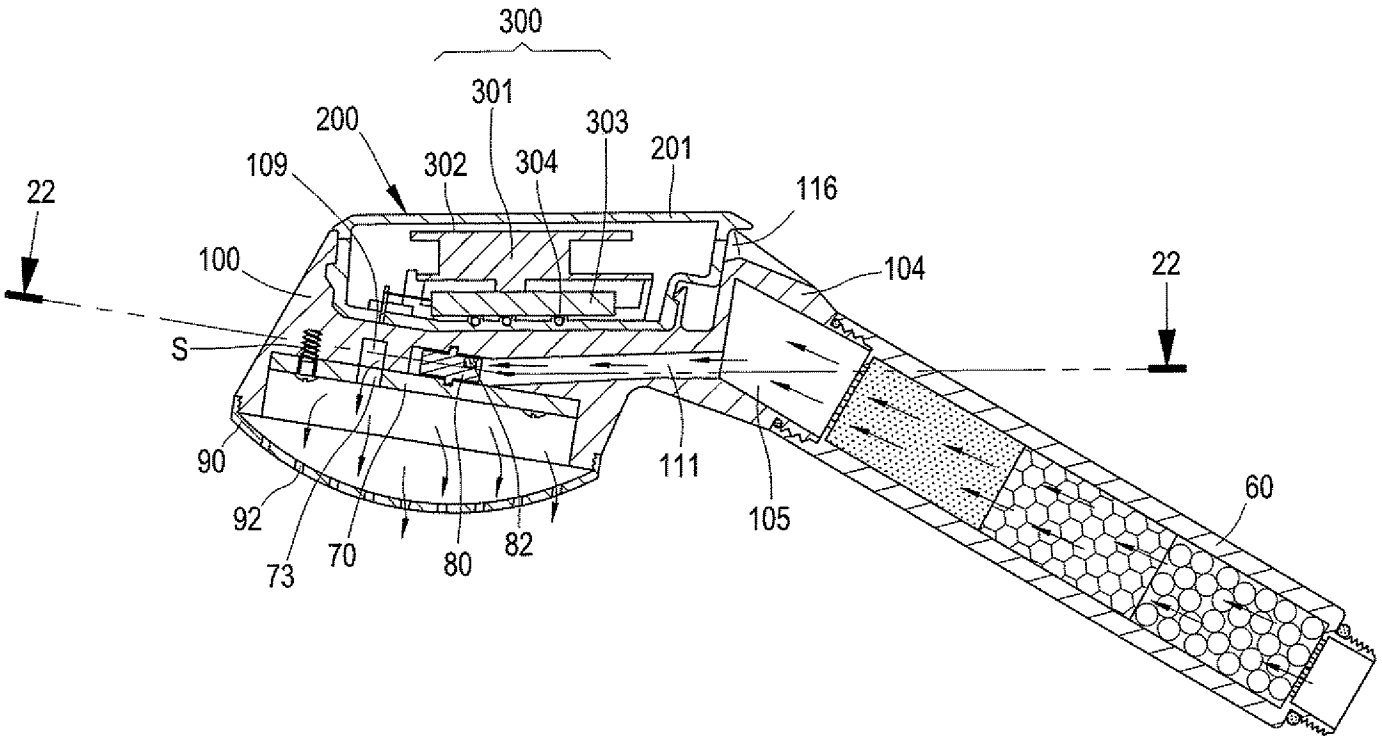
FIG. 21 is a cross sectional view taken from the 21-21 section line of previous FIG. 20.

For structure in the first preferred exemplary embodiment of the present invention, please further refer to FIGS. 4 to 11 and FIG. 14. The hand held shower head with filter replacing pre-alarm device here comprises a shower head shell 100, a handle filter 60, an internal lid 70, an impeller 80, a hood 90, a detachable alerting pod 200 and a signal circuit device 300, wherein:

said shower head shell 100, which is a plastic hollow casing extruded into unitary piece having a mantle 103 encompassed an obverse side 101 with a set of rim male threads 120 and a reverse side 102 as an integral body, has a handle butt 104 with a set of tubular threads 106 formed on the tapered peripheral thereof to connect with the handle filter 60, a hollow water entry 105 created in the handle butt 104, a receptacle 107 inwardly created into the obverse side 101, a water exit bore base 109 and an impeller well 108 with an impeller hub notch 110 further inwardly created into internal bottom of the receptacle 107, a water inlet channel 111 created to communicate between the hollow water entry 105 in the handle butt 104 and the adjacent side of the impeller well 108 while a water outlet channel 112 created to communicate between the water exit bore base 109 and the other side of the impeller well 108 (as dotted line portion shown in FIG. 6), and a round recess socket 113 inwardly created into the reverse side 102 to be having the detachable alerting pod 200 embedded therein such that a terminal latching nick 114 is created in the distal internal wall (left in figure) of the recess socket 113 (as left upper enlarged view shown in FIG. 5) while a snap latching jut 115 is created in the proximal internal wall (right in figure) of the recess socket 113 (as right upper enlarged view shown in FIG. 5), as well as a finger guiding groove 116 created into the top surface of the handle butt 104 abutting the rim of the reverse side 102;

said handle filter 60 is a filter cartridge disposed in a detachable handle with a set of female threads formed in jointing end section thereof to be mated with the set of tubular threads 106 of the handle butt 104 (as shown in FIGS. 20 and 21);

said internal lid 70, which is a planiform disk tightly attached on the bottom side of the receptacle 107 in the shower head shell 100, has an inward surface 71 facing toward the obverse side 101 of the shower head shell 100, an impeller hub notch 72 created therein to correspond with the impeller hub notch 110 of the impeller well 108, a water outlet 73 created therein to correspond with the water exit bore base 109 of the receptacle 107 in the shower head shell 100, and a plurality of screw holes 74 peripherally created the marginal rim thereof such that the screw holes 74 spread around the impeller hub notch 72 and water outlet 73;

said impeller 80, which is a cylindrical profile body with plural curved vanes equivalently extending radically, has two central protruding hubs 81 being coaxially disposed at top side and bottom side thereof respectively, and a magnetic element 82 embedded in the top cut of one vane (as shown in FIG. 8) such that the impeller 80 is freely rotatable in the impeller well 108 by means of two central protruding hubs 81 being mated with the impeller hub notch 110 of the impeller well 108 and the impeller hub notch 72 of the internal lid 70 respectively (as shown in FIG. 14);

said hood 90, which is a plastic disk extruded into unitary piece, has a hoop female threads 91 created around the bottom rim thereof and a plurality of water spray holes 92 spread over the surface thereof so that the hoop female threads 91 can mate with the rim male threads 120 on the obverse side 101 of the shower head shell 100 by screwing engagement (as shown in FIG. 9) while the water spray holes 92 enable the water in the receptacle 107 on the obverse side 101 of the shower head shell 100 to jet out;

said alerting pod 200, which is a plastic capsule made by a plastic transparent lid 201 and a plastic mounting cavity 202 via high frequency fusion method into a hermetically watertight integral body to be embedded into the round recess socket 113 of the reverse side 102 in the shower head shell 100 for accommodating the signal circuit device 300 therein (as shown in FIGS. 10 and 11), has a terminal latching jut 203 created on the heading rim thereof (left in figure) while a snap latching nick 204 created on the rear rim thereof (right in figure), and two passive recharging electrodes 205 firmly inset internal bottom wall of the mounting cavity 202 with each one individual end of the two passive recharging electrodes 205 protruding out of the mounting cavity 202 (as lower enlarged view shown in FIG. 11); and said signal circuit device 300, which is contained in the alerting pod 200, includes a microprocessor 301, a LCD display circuit 302 electrically connected to the microprocessor 301 with its location near the transparent lid 201, a rechargeable battery 303 electrically connected to the microprocessor 301, and a magnetic reed switch 304 securely inset on the internal bottom side of the mounting cavity 202 (as shown in FIG. 10) such that the rechargeable battery 303 is connected with the passive recharging electrode 205 of the alerting pod 200 via a pair of wires W (as lower enlarged view shown in FIG. 11), wherein the rechargeable battery 303 can be either nickel-chromium battery or lithium battery, and the magnetic reed switch 304 can be replaced by Hall-effect component.

Figure 12:
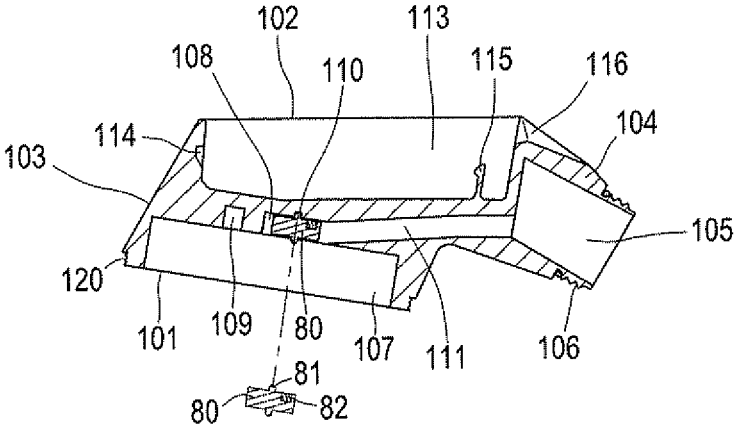
FIG. 12 is the first assembly view for a hand held shower head with filter replacing pre-alarm device in the first preferred exemplary embodiment of the present invention.
Figure 13:
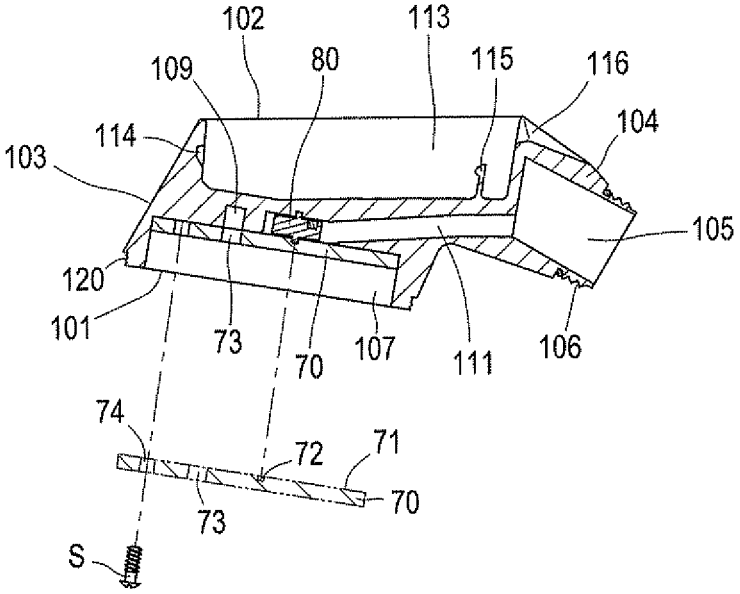
FIG. 13 is the second assembly view for a hand held shower head with filter replacing pre-alarm device in the first preferred exemplary embodiment of the present invention.
Figure 15:
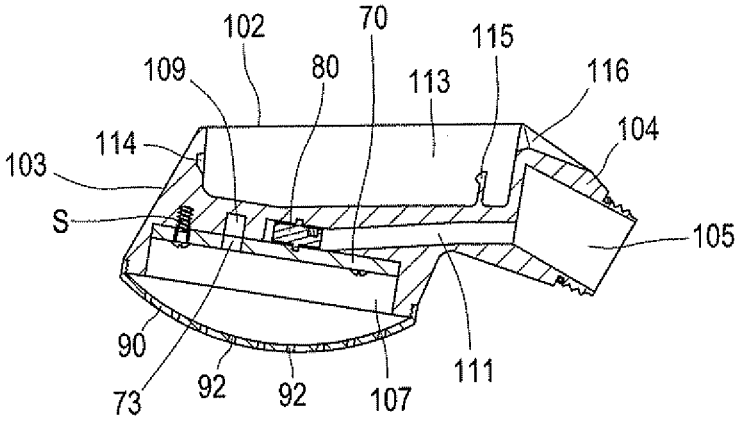
FIG. 15 is the fourth assembly view for a hand held shower head with filter replacing pre-alarm device in the first preferred exemplary embodiment of the present invention.
Figure 16:
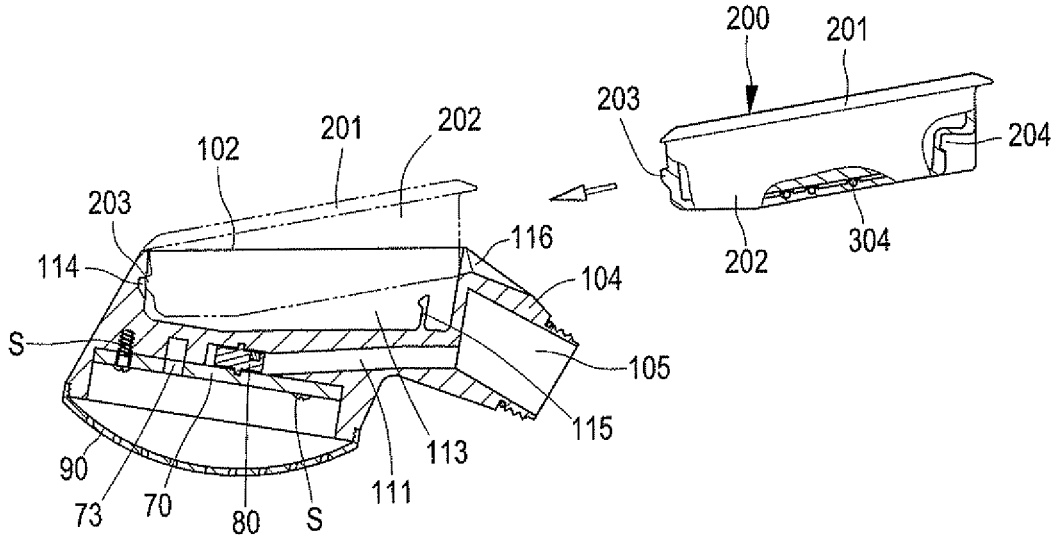
FIG. 16 is the first illustrative view for showing the assembly of an alerting pod with a shower head shell in the first preferred exemplary embodiment of the present invention.
Figure 17:
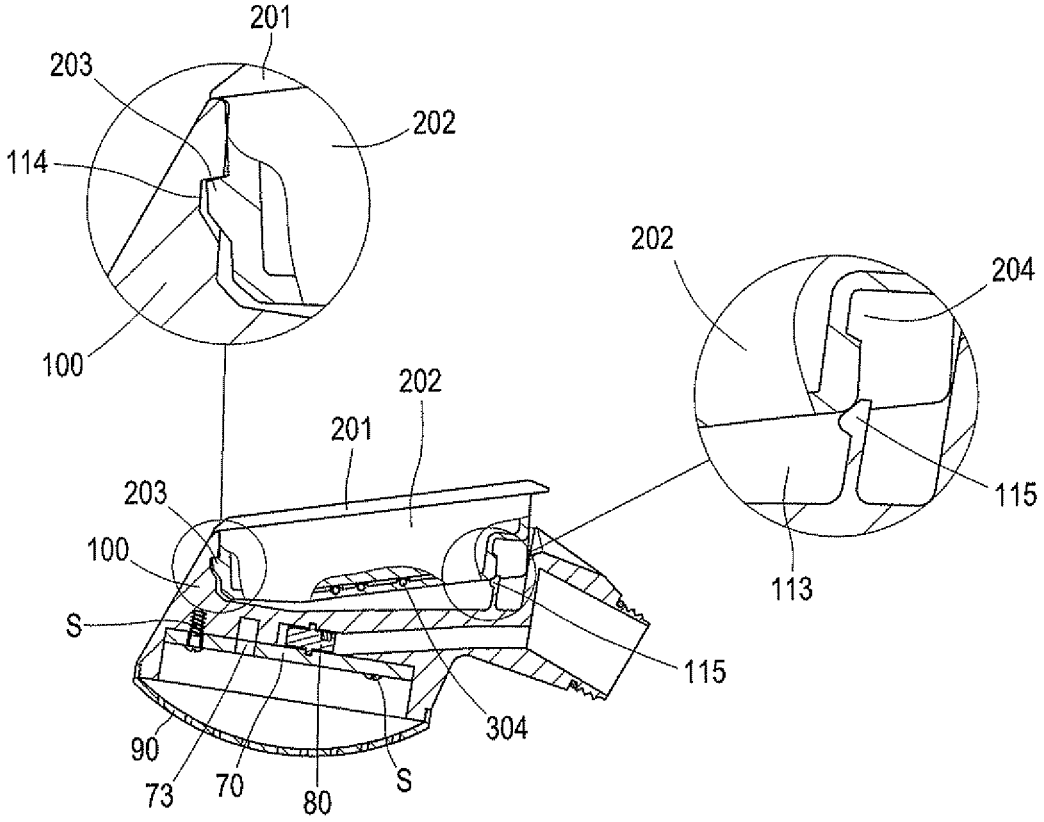
FIG. 17 is the second illustrative view for showing the assembly of an alerting pod with a shower head shell in the first preferred exemplary embodiment of the present invention.
Figure 18:
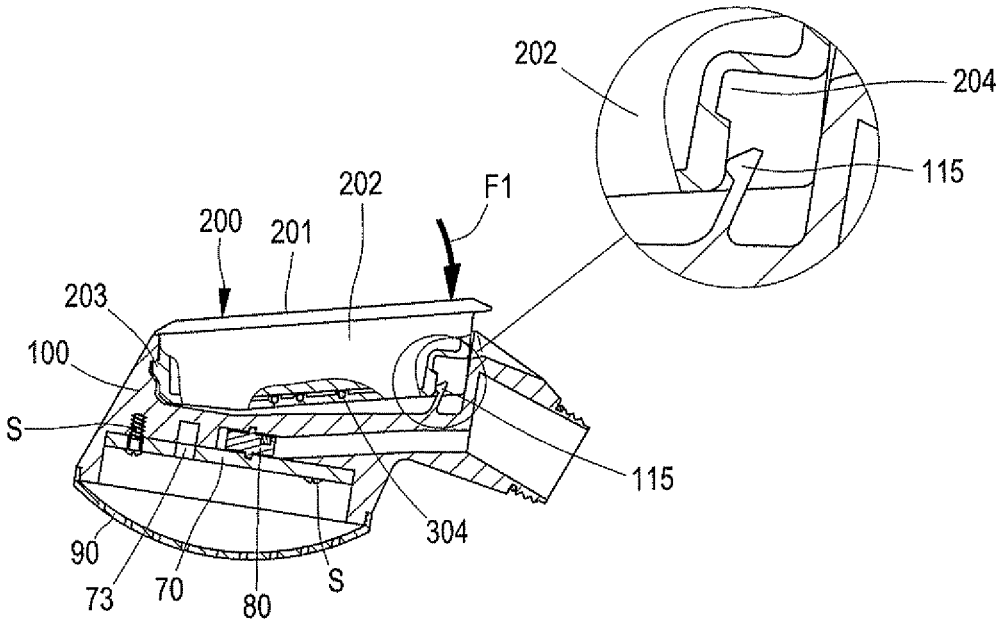
FIG. 18 is the third illustrative view for showing the assembly of an alerting pod with a shower head shell in the first preferred exemplary embodiment of the present invention.
Figure 19:
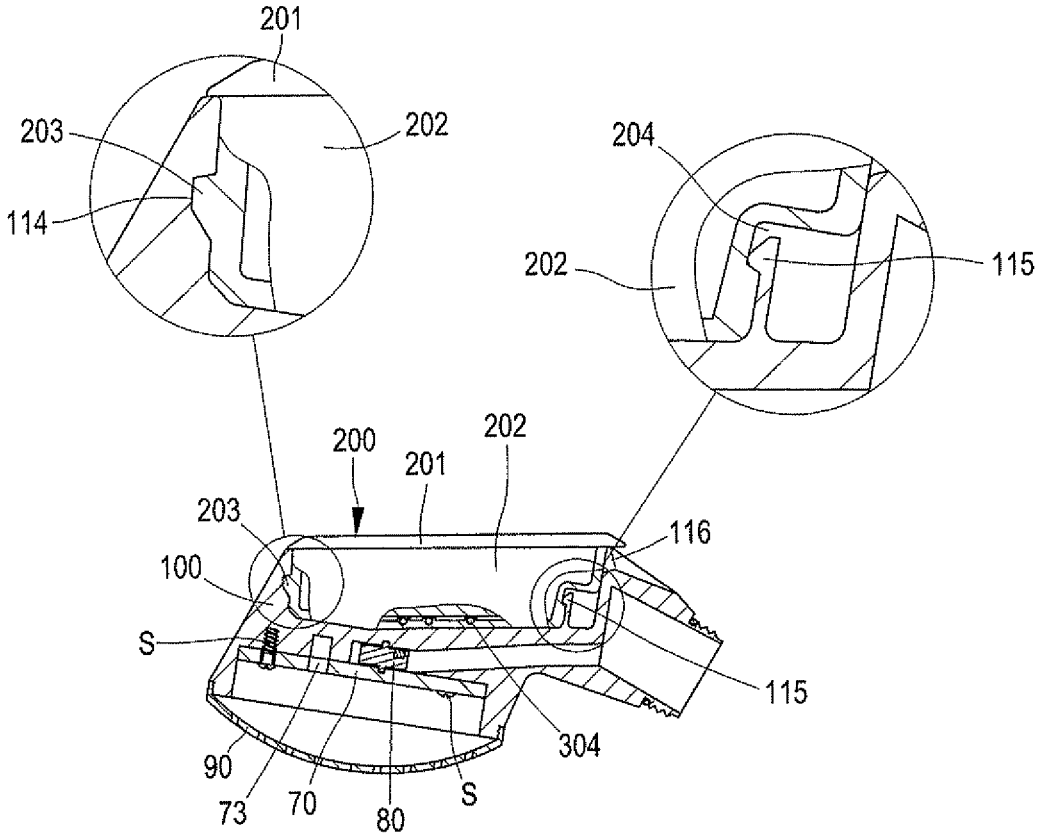
FIG. 19 is the fourth illustrative view for showing the assembly of an alerting pod with a shower head shell in the first preferred exemplary embodiment of the present invention.

For assembly steps in the first preferred exemplary embodiment of the present invention, please further refer to FIGS. 12 to 19.

a. Align the protruding hub 81 (upper side in figure) of the impeller 80 having magnetic element 82 in one vane with the impeller hub notch 110 of the impeller well 108 in the obverse side 101 of the shower head shell 100, then put the protruding hub 81 into the impeller hub notch 110 so that the magnetic element 82 of the impeller 80 faces toward the recess socket 113 of the shower head shell 100 (as shown in FIG. 12).

b. Attach the inward surface 71 of the internal lid 70 against the top surface of the receptacle 107 in the shower head shell 100 so that the impeller hub notch 72 of the internal lid 70 sleeves over the other protruding hub 81 of the impeller 80 (as lower side shown in FIG. 13), drive every self-tapping screws S into the internal bottom wall of the receptacle 107 via corresponding screw hole 74 of the internal lid 70 respectively so that the internal lid 70 closely attach with the top surface of the receptacle 107 to allow the impeller 80 be freely rotatable in the impeller well 108 (as shown in FIG. 14).

c. Mate the hoop female threads 91 on the hood 90 with the rim male threads 120 on the obverse side 101 of the shower head shell 100 by screwing engagement to complete the assembly for the obverse side 101 of the shower head shell 100 (as shown in FIG. 15).

d. Align and mate the terminal latching jut 203 in the mounting cavity 202 of the alerting pod 200 with the terminal latching nick 114 in the recess socket 113 of the reverse side 102 of the shower head shell 100 (as shown in FIG. 16 and left upper enlarged view shown in FIG. 17) so that the bottom side of the snap latching nick 204 in the mounting cavity 202 will contact with the top side of the snap latching jut 115 in the recess socket 113 (as right upper enlarged view shown in FIG. 17). Then, thoroughly latch the snap latching nick 204 in the mounting cavity 202 with the snap latching jut 115 of the recess socket 113 by forcibly applying downward force F1 over the transparent lid 201 (as right upper enlarged view shown in FIG. 19) so that the terminal latching jut 203 in the mounting cavity 202 also fully latches with the terminal latching nick 114 in the recess socket 113 simultaneously (as left upper enlarged view shown in FIG. 19) to complete the assembly for the alerting pod 200 and shower head shell 100. Thus the overall assembly steps in the first preferred exemplary embodiment of the present invention are finished.

Figure 22:
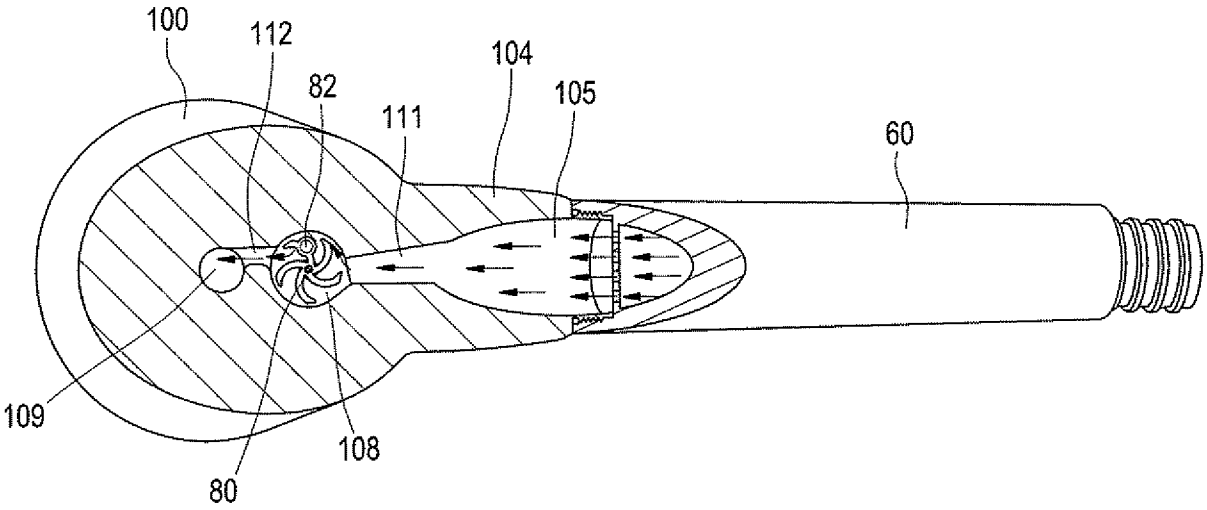
FIG. 22 is a cross sectional view taken from the 22-22 section line of previous FIG. 21.

For operation mode in the first preferred exemplary embodiment of the present invention, please further refer to FIGS. 20 to 22.

Prior to operate the shower head, firstly screw the handle filter 60 with the tubular threads 106 on the handle butt 104 of the shower head shell 100, then connect a detachable water pipe P to the handle filter 60 (as shown in FIG. 20). Once the shower head is hooked up, the tap water enters into the impeller well 108 orderly via the handle filter 60, the water entry 105 in the handle butt 104, and the water inlet channel 111 to drive the impeller 80 rotate. Then, the tap water in the impeller well 108 flows out of the water outlet 73 in the internal lid 70 orderly via the water outlet channel 112 and the water exit bore base 109. Finally, the tap water is jetted out of the water spray holes 92 in the hood 90 (as shown in FIGS. 21 and 22). Wherein, for each rotation of the impeller 80 driven by the running water, the magnetic element 82 thereof simultaneously switches the magnetic reed switch 304 in the alerting pod 200 one time to induce a switching signal, which is relayed to the microprocessor 301 in the signal circuit device 300 for being processed to generate an accumulated data in certain preset interval for further transmitting to the LCD display circuit 302 for displaying related quantity of water flux thereon in accordance with following formula:

$$\text{Quantity of water flux}(Q)=\text{Cross sectional area}(A)\ \text{times Flow velocity}(V)$$

Thereby, a user of the shower head can get real time statistical data of the total filtered water quantity flowed through handle filter 60 by simply means of looking at the LCD display circuit 302 via the transparent lid 201 of the alerting pod 200. Once the total filtered water quantity flowed through handle filter 60 reaches (or near reaches) a predetermined critical value for the rated service life time of the specific handle filter 60, the microprocessor 301 will send a alerting signal with current data of the total filtered water quantity to the LCD display circuit 302 for reminding the user to notice that it is the time to replace the handle filter 60 timely to assure good quality of the handle filter 60 and filtered water thereby. Therefore, the user can avoid the harmful consequences to the health caused by the unclean water incurred by missing the replacement time and still continuously use the ineffective handle filter 60.

Figure 25:
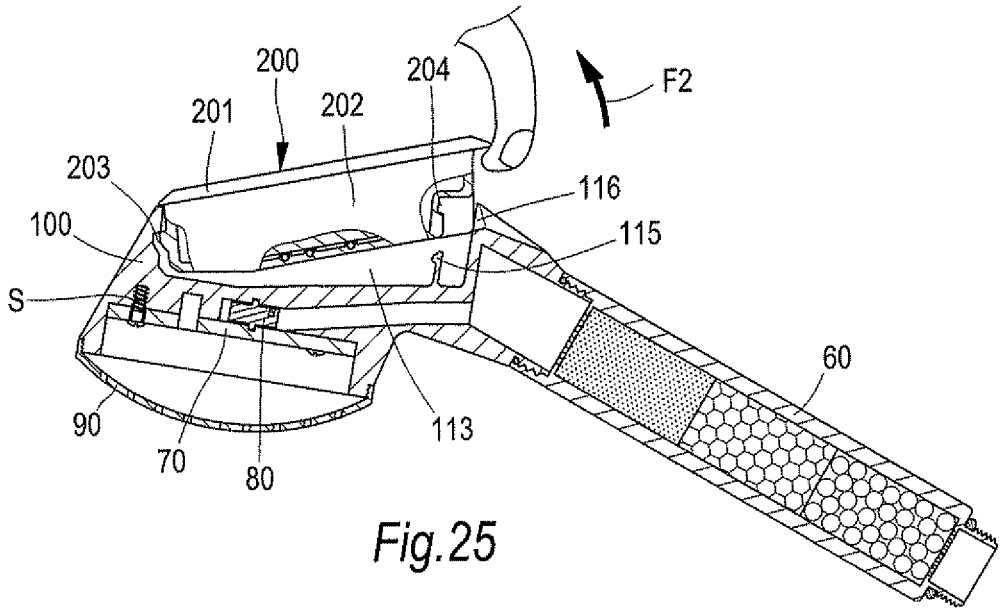
FIG. 25 is the third illustrative view showing the lift of an alerting pod for detaching off a shower head shell in the first preferred exemplary embodiment of the present invention.
Figure 26:
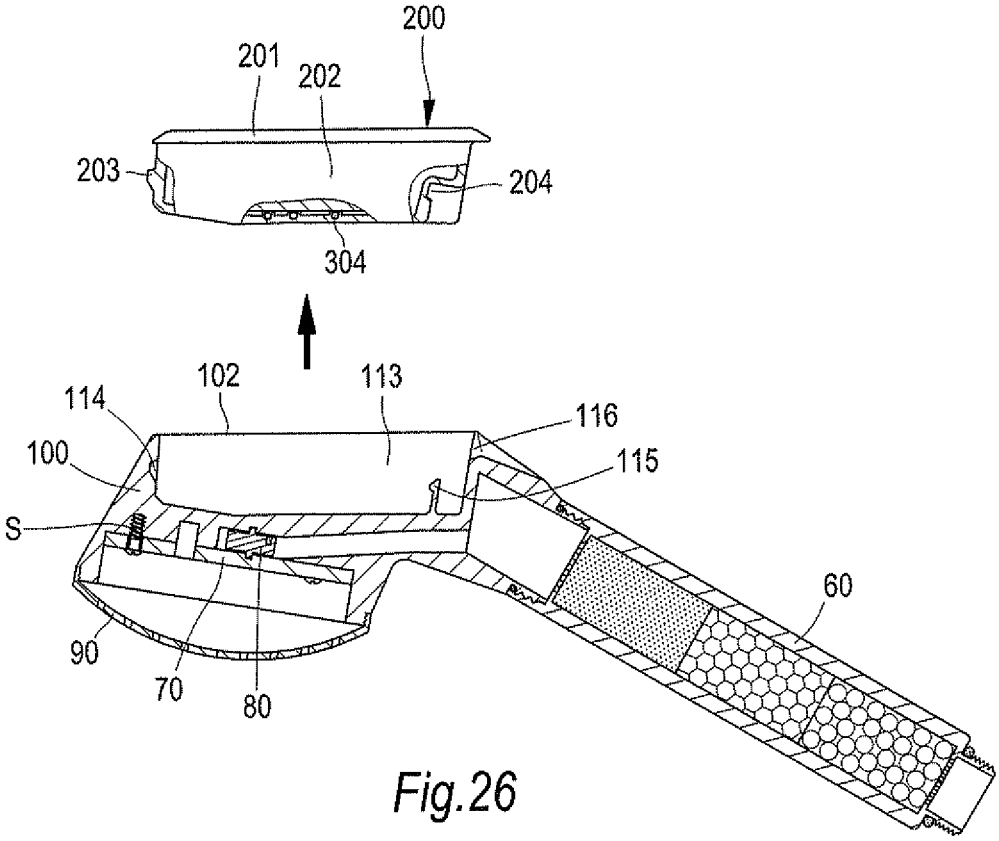
FIG. 26 is the fourth illustrative view showing the lift of an alerting pod for detaching off a shower head shell in the first preferred exemplary embodiment of the present invention.
Figure 28:
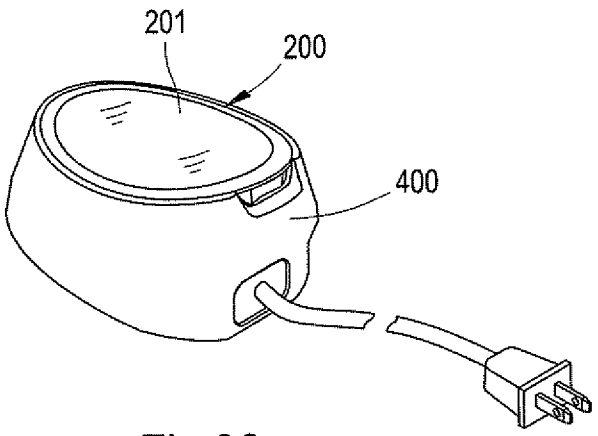
FIG. 28 is a perspective schematic view showing an alerting pod is imbedded into a battery recharging mount in the first preferred exemplary embodiment of the present invention.
Figure 27:
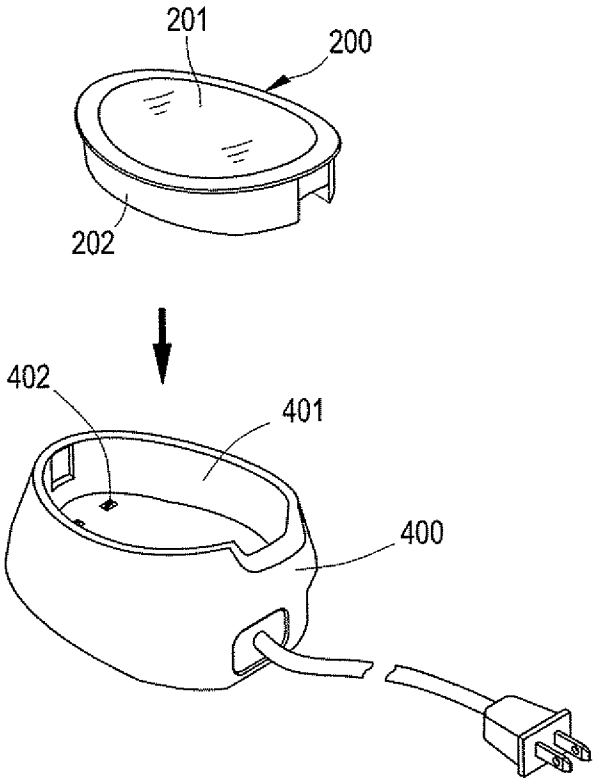
FIG. 27 is a perspective schematic view showing a separated alerting pod to be imbedded into a battery recharging mount in the first preferred exemplary embodiment of the present invention.

For replacing or recharging the handle filter 60, please further refer to FIGS. 23 to 28. The first preferred exemplary embodiment for the hand held shower head with filter replacing pre-alarm device of the present invention further comprises a battery recharging mount 400, which includes a battery recharging cavity 401 with a pair of active recharging electrodes 402 to securely contact the corresponding pair protruding ends of the passive recharging electrodes 205 in the mounting cavity 202 of the alerting pod 200 for performing suitably recharging operation to the rechargeable battery 303 in the alerting pod 200. Wherein, the profile of the battery recharging cavity 401 is contrived to resemble but slightly bigger than the profile of the mounting cavity 202 in the alerting pod 200 to adequately accommodate the mounting cavity 202 therein for performing suitably recharging operation to the rechargeable battery in the alerting pod (as shown in FIGS. 27 and 28).

Figure 23:
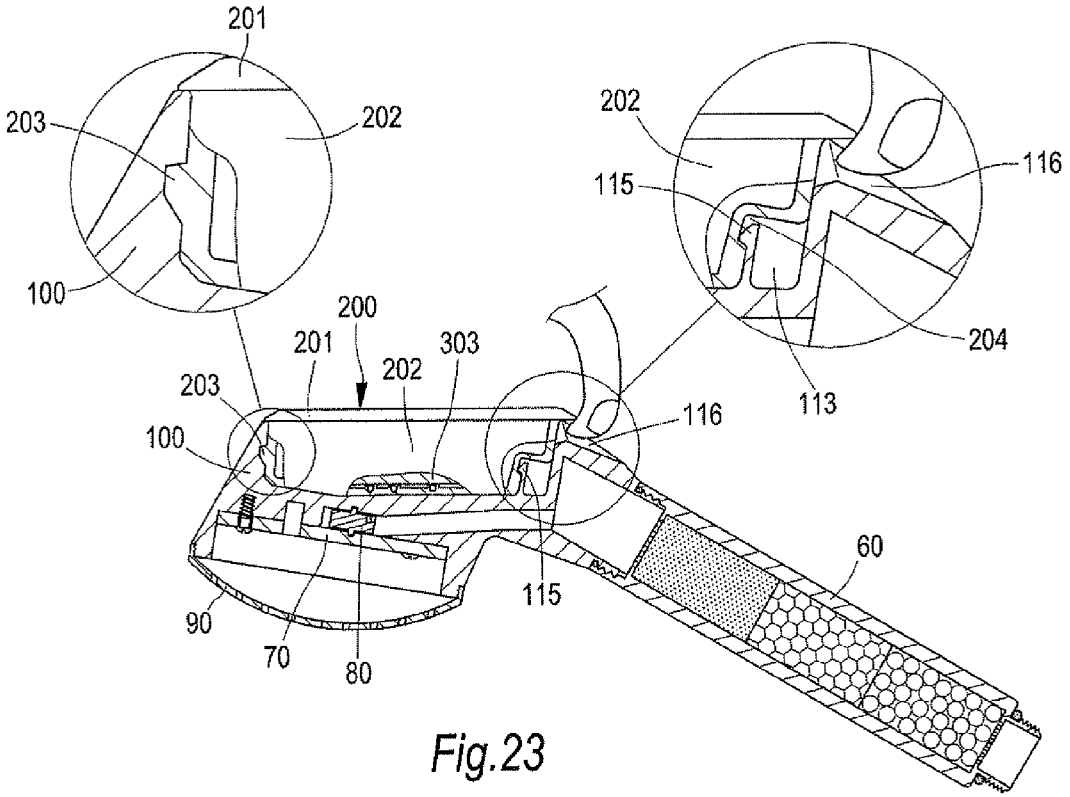
FIG. 23 is the first illustrative view showing the lift of an alerting pod for detaching off a shower head shell in the first preferred exemplary embodiment of the present invention.
Figure 24:
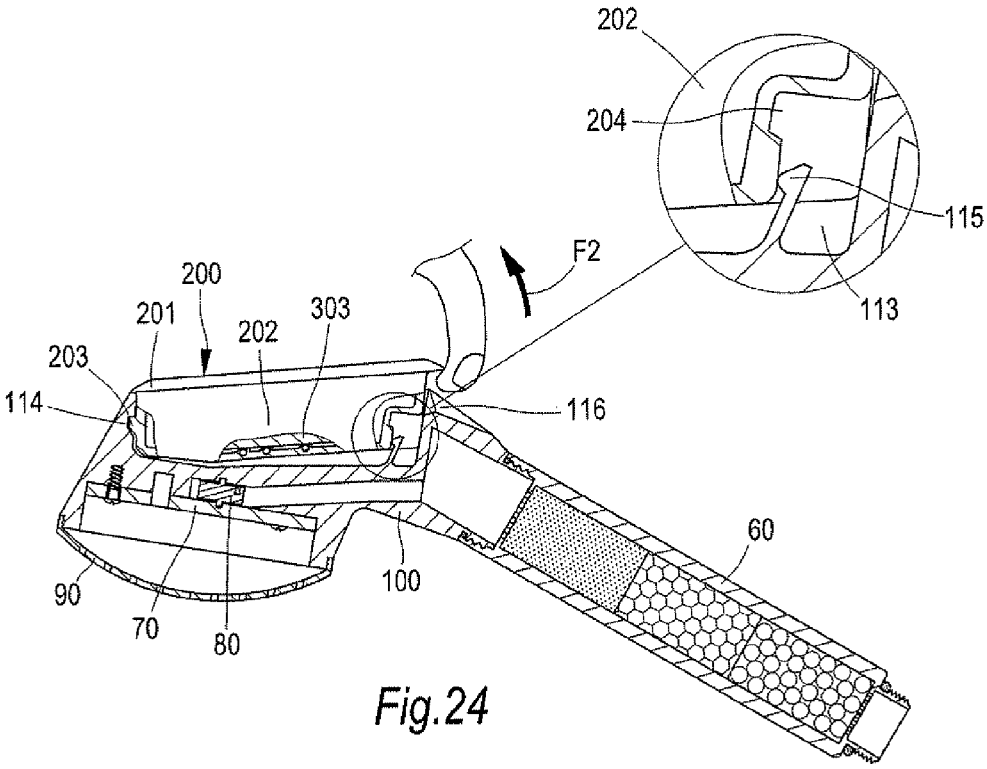
FIG. 24 is the second illustrative view showing the lift of an alerting pod for detaching off a shower head shell in the first preferred exemplary embodiment of the present invention.

The power of the rechargeable battery 303 in the alerting pod 200 might run out when the handle filter 60 has been replaced several times. In operation mode of replacing or recharging the handle filter 60, firstly, hook the marginal edge of the transparent lid 201 in the alerting pod 200 by one finger along the finger guiding groove 116 in the reverse side 102 of the shower head shell 100 (as shown in FIG. 23), then apply an upward force F2 on the mounting cavity 202 (as shown in FIG. 24), the snap latching nick 204 of the alerting pod 200 will bounce off the snap latching jut 115 in the recess socket 113 of the shower head shell 100 (as right upper enlarged view shown in FIG. 24); secondly, continuously apply an upward force F2 on the mounting cavity 202, the entire alerting pod 200 will fully detach off the recess socket 113 in the reverse side 102 of the shower head shell 100 (as shown in FIGS. 25 and 26); and finally, insert the detached alerting pod 200 into the battery recharging cavity 401 of the battery recharging mount 400, the rechargeable battery 303 in the alerting pod 200 will be properly recharged (as shown in FIGS. 27 and 28).

Accordingly, the alerting pod 200 can be either inserted into the recess socket 113 in the reverse side 102 of the shower head shell 100 for normal measuring and alerting function or detached off the recess socket 113 for battery recharging operation. Thereby, not only the shower head shell 100 can be adequately powered but also the alerting pod 200 can be separated out of the shower head shell 100 for recharging operation in isolated manner so that the issues happened in the conventional "hand held shower head with filter replacing pre-alarm device" are completely solved that the entire shower head shell 100 is unnecessary to discarded and replaced even the DC power supply in the signal circuit device 300 is running out. Thus, it not only saves resource waste but also conserves economical expense incurred by frequent replacement of the shower head. Consequently, it becomes a marketing advantage due to enhance the desire in continuously using the "hand held shower head with filter replacing pre-alarm device" of the present invention.

Figure 29:
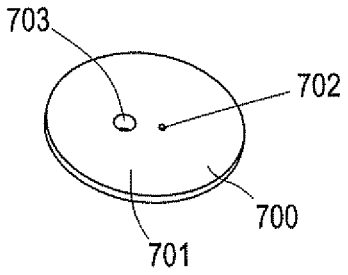
FIG. 29 is a perspective schematic view for an internal lid for a hand held shower head with filter replacing pre-alarm device in the second preferred exemplary embodiment of the present invention.
Figure 30:
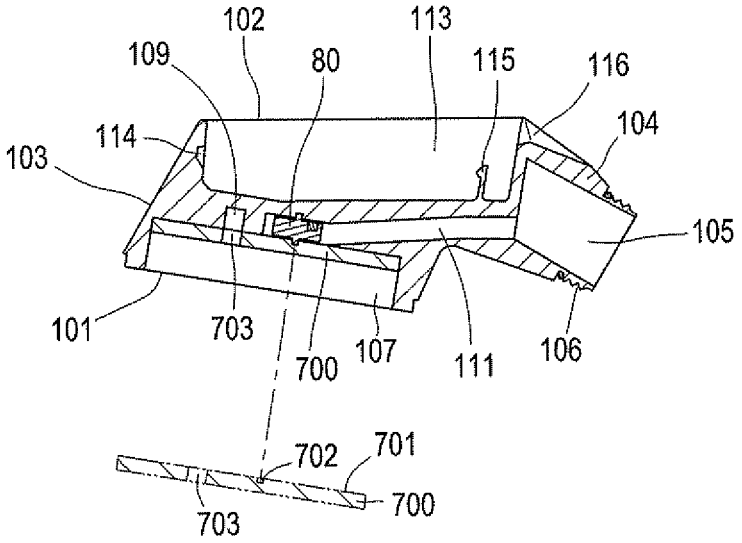
FIG. 30 is a perspective schematic view showing the assembly of an internal lid with a shower head in the second preferred exemplary embodiment of the present invention.

For structure in the second preferred exemplary embodiment of the present invention, please further refer to FIGS. 29 and 30. Here, the internal lid 700 in the previous first preferred exemplary embodiment of the present invention is adapted into a plastic planiform disk extruded into unitary piece such that adapted internal lid 700 combines the shower head shell 100 as an integral body via high frequency fusion method after it is tightly attached on the bottom side of the receptacle 107 in the shower head shell 100 (as shown in FIG. 30). The adapted internal lid 700 comprises an inward surface 701 with a impeller hub notch 702 and a water outlet 703 therein, wherein the impeller hub notch 702 is to correspond with the impeller hub notch 110 of the impeller well 108 while the water outlet 703 is to correspond with the water exit bore base 109 of the receptacle 107 in the shower head shell 100.

Figure 31:
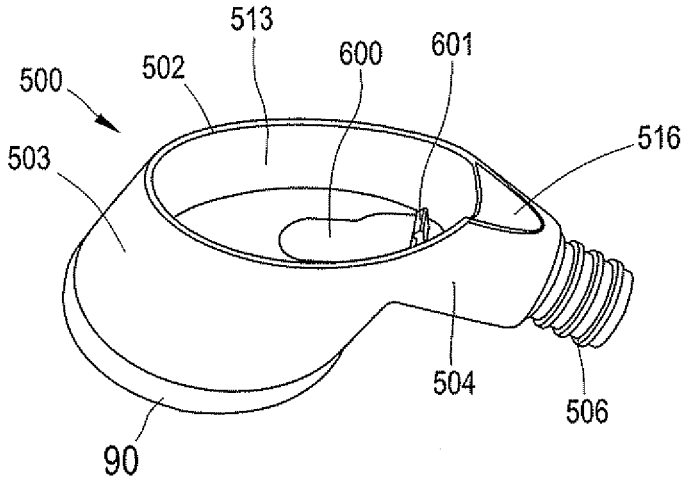
FIG. 31 is a perspective assembly view for a hand held shower head with filter replacing pre-alarm device in the third preferred exemplary embodiment of the present invention.
Figure 32:
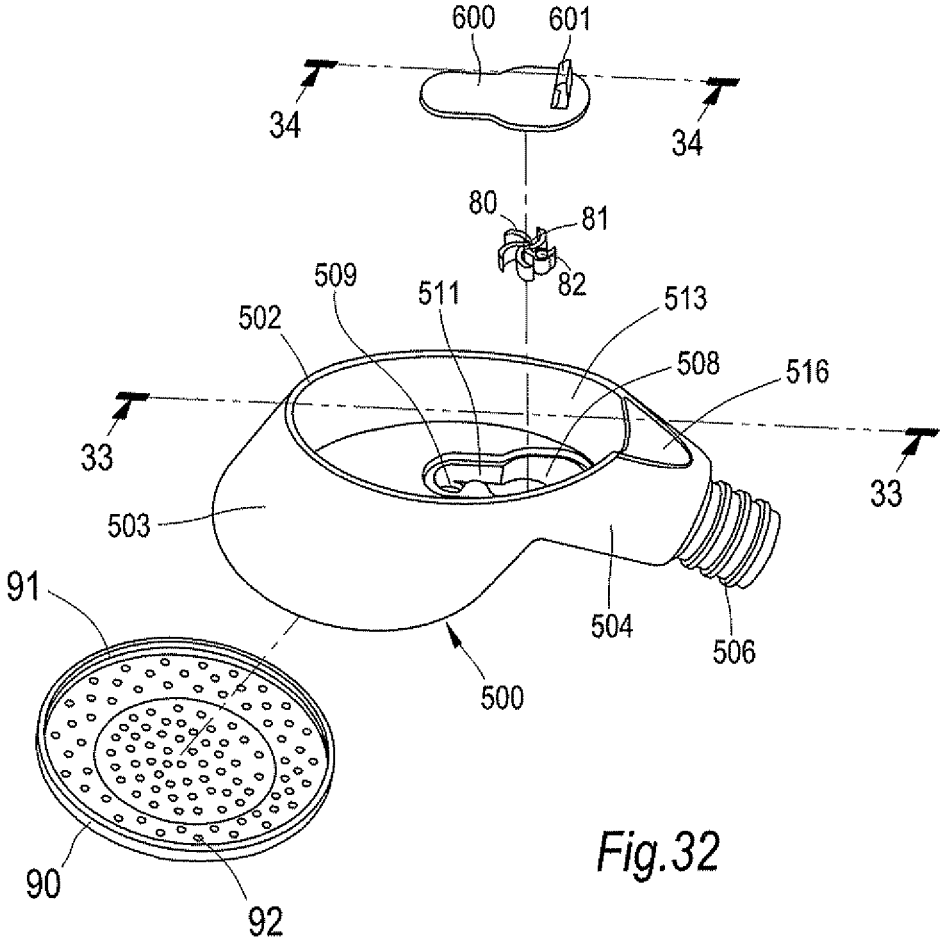
FIG. 32 is a perspective exploded view for a hand held shower head with filter replacing pre-alarm device in the third preferred exemplary embodiment of the present invention.
Figure 33:
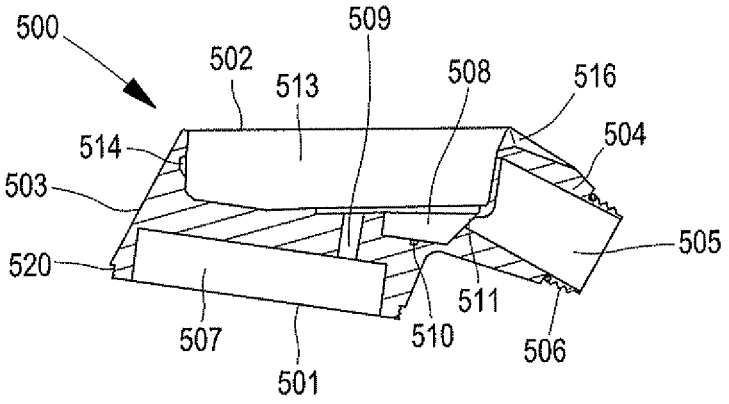
FIG. 33 is a cross sectional view taken from the 33-33 section line of previous FIG. 32.
Figure 34:
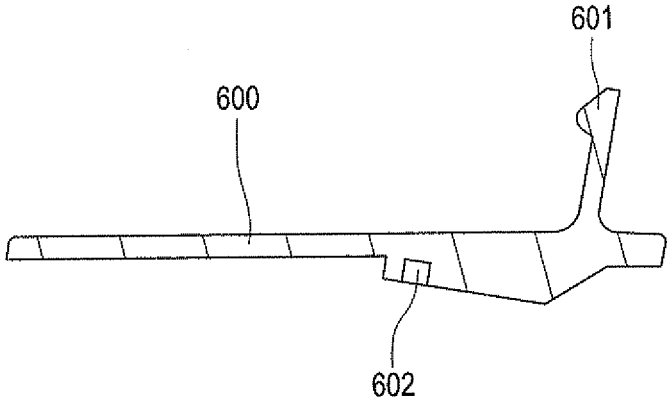
FIG. 34 is a cross sectional view taken from the 34-34 section line of previous FIG. 32.
Figure 35:
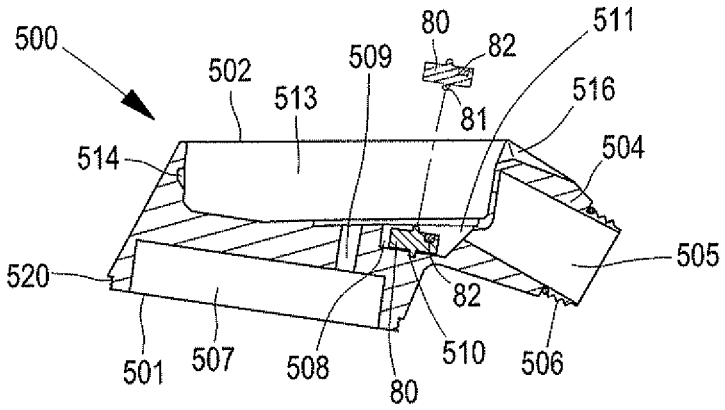
FIG. 35 is the first assembly view for a hand held shower head with filter replacing pre-alarm device in the third preferred exemplary embodiment of the present invention.
Figure 36:
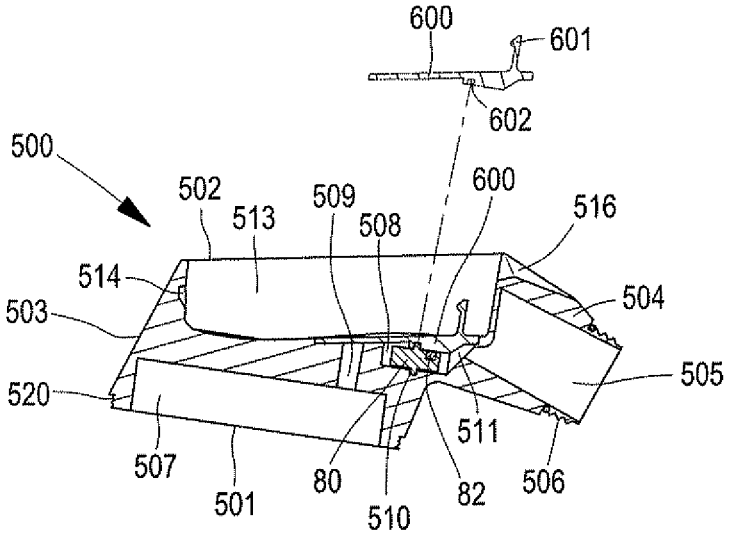
FIG. 36 is the second assembly view for a hand held shower head with filter replacing pre-alarm device in the third preferred exemplary embodiment of the present invention.
Figure 41:
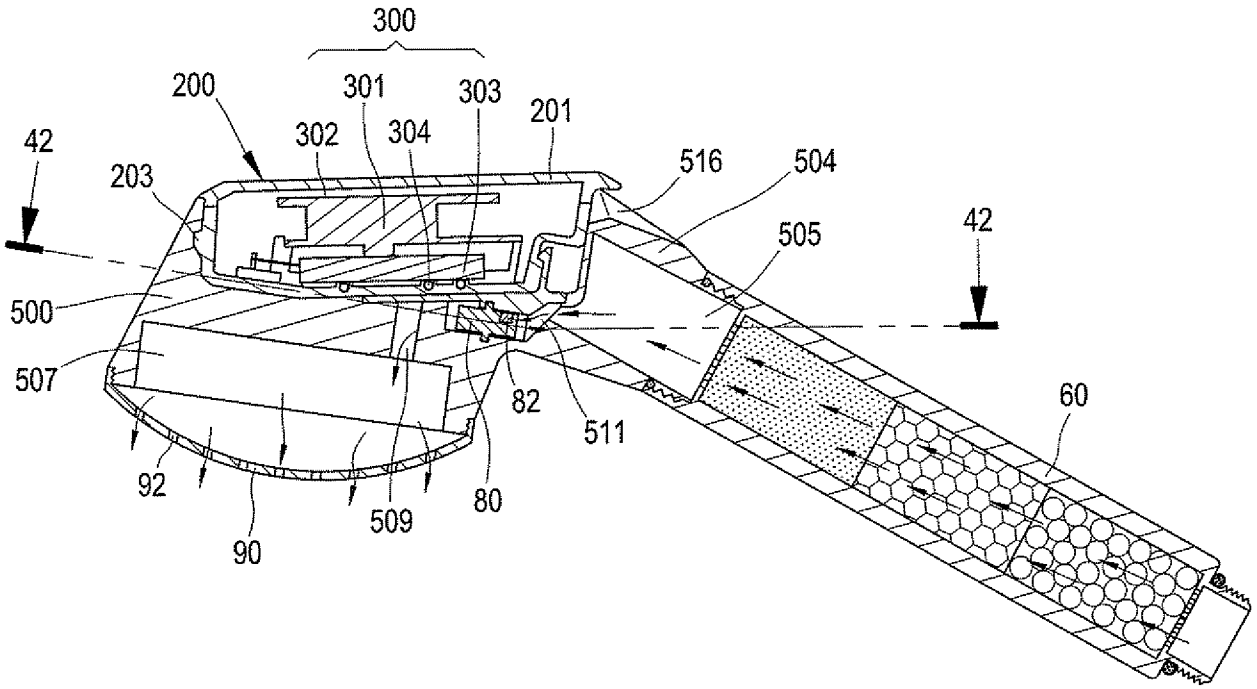
FIG. 41 is an operation illustrative view for a hand held shower head with filter replacing pre-alarm device in the third preferred exemplary embodiment of the present invention.
Figure 42:
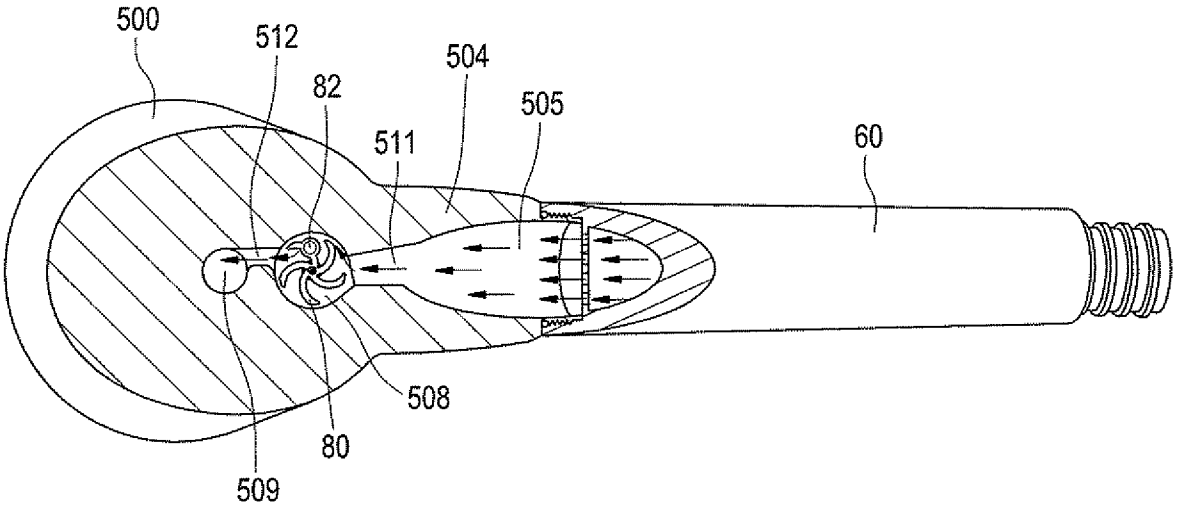
FIG. 42 is a cross sectional view taken from the 42-42 section line of previous FIG. 41.

For structure in the third preferred exemplary embodiment of the present invention, please further refer to FIGS. 31 to 34 as well as FIGS. 10 and 11. The hand held shower head with filter replacing pre-alarm device here comprises a shower head shell 500, a handle filter 60, an internal panel 600, an impeller 80, a hood 90, a detachable alerting pod 200 and a signal circuit device 300, wherein:

said shower head shell 500, which is a plastic hollow casing extruded into unitary piece having a mantle 503 encompassed an obverse side 501 with a set of rim male threads 520 and a reverse side 502 as an integral body, has a handle butt 504 with a set of tubular threads 506 formed on the tapered peripheral thereof to connect with the filter hand hold 60, a hollow water entry 505 created in the handle butt 504, a receptacle 507 inwardly created into the obverse side 501, a finger guiding groove 516 created into the top surface of the handle butt 504 abutting the rim of the reverse side 502, and a round recess socket 513 inwardly created into the reverse side 502 to be having the detachable alerting pod 200 embedded therein such that a terminal latching nick 514 is created in the distal internal wall of the recess socket 513 (as shown in FIGS. 31 and 32) while an impeller well 508 with an impeller hub notch 510 and a water outlet 509 are respectively created into the proximal internal bottom wall of the recess socket 513 near the hollow water entry 505 of the handle butt 504, as well as a water inlet channel 511 created to communicate between the hollow water entry 505 in the handle butt 504 and the adjacent side of the impeller well 508 while a water outlet channel 512 created to communicate between the water outlet 509 and the other side of the impeller well 508, wherein the water outlet 509 is communicable with the receptacle 507 (as shown in FIG. 33);

said handle filter 60 is a filter cartridge disposed in a detachable handle with a set of female threads formed in jointing end section thereof to be mated with the set of tubular threads 506 of the handle butt 504 (as shown in FIGS. 41 and 42);

said internal panel 600, which is a plastic planiform disk extruded into unitary piece, has a snap latching jut 601 created on the top surface thereof and an impeller hub notch 602 created in the bottom surface thereof (as shown in FIG. 34), functions to block the top opening of the impeller well 508 in the round recess socket 513 and top opening of the water outlet 509 in blind manner with result that only the lower end opening of the water outlet 509 is communicable to the receptacle 507 when the bottom surface of the internal panel 600 closely attaches and seals the upper internal bottom surface of the round recess socket 513 in the reverse side 502 of the shower head shell 500 by high frequency fusion method such that both of the internal panel 600 combines with the shower head shell 500 as an integral body (as shown in FIG. 36);

said impeller 80, which is a cylindrical profile body with plural curved vanes equivalently extending radically, has two central protruding hubs 81 being coaxially disposed at top side and bottom side thereof respectively, and a magnetic element 82 embedded in the top cut of one vane (as shown in FIG. 8) such that the impeller 80 is freely rotatable in the impeller well 508 by means of two central protruding hubs 81 being mated with the impeller hub notch 510 of the impeller well 508 and the impeller hub notch 602 of the internal panel 600 respectively (as shown in FIG. 35);

said hood 90, which is a plastic disk extruded into unitary piece, has a hoop female threads 91 created around the bottom rim thereof and a plurality of water spray holes 92 spread over the surface thereof so that the hoop female threads 91 can mate with the rim male threads 520 on the obverse side 501 of the shower head shell 500 by screwing engagement (as shown in FIG. 9) while the water spray holes 92 enable the water in the receptacle 507 on the obverse side 501 of the shower head shell 500 to jet out;

said alerting pod 200, which is a plastic capsule made by a plastic transparent lid 201 and a plastic mounting cavity 202 via high frequency fusion method into a hermetically watertight integral body to be embedded into the recess socket 513 of the reverse side 502 in the shower head shell 500 for accommodating the signal circuit device 300 therein, has a terminal latching jut 203 created on the heading rim thereof while a snap latching nick 204 created on the rear rim thereof, and two passive recharging electrodes 205 firmly inset internal bottom wall of the mounting cavity 202 with each one individual end of two passive recharging electrodes 205 protruding out of the mounting cavity 202 (as lower enlarged view shown in FIG. 11); and said signal circuit device 300, which is contained in the alerting pod 200, includes a microprocessor 301, a LCD display circuit 302 electrically connected to the microprocessor 301 with its location near the transparent lid 201, a rechargeable battery 303 electrically connected to the microprocessor 301, and a magnetic reed switch 304 securely inset on the internal bottom side of the mounting cavity 202 (as shown in FIG. 10) such that the rechargeable battery 303 is connected with the passive recharging electrode 205 of the alerting pod 200 via a pair of wires W (as lower enlarged view shown in FIG. 11), wherein the rechargeable battery 303 can be either nickel-chromium battery or lithium battery, and the magnetic reed switch 304 can be replaced by Hall-effect component.

Figure 37:
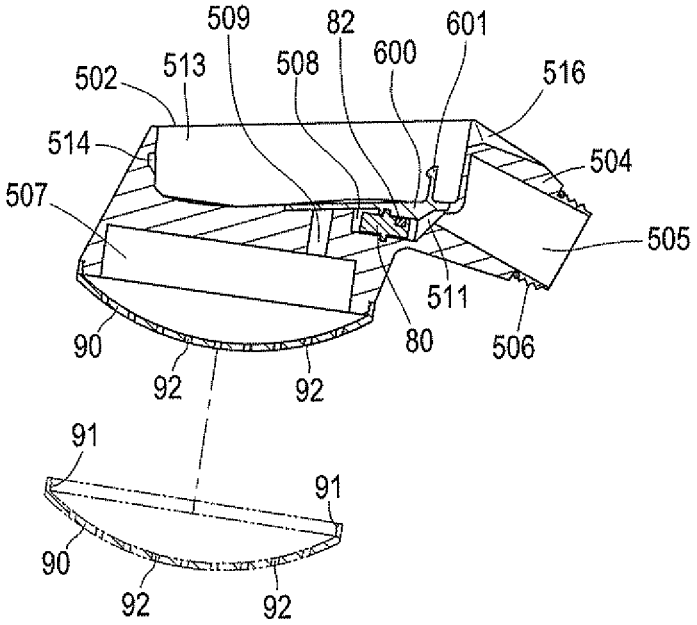
FIG. 37 is the third assembly view for a hand held shower head with filter replacing pre-alarm device in the third preferred exemplary embodiment of the present invention.
Figure 38:
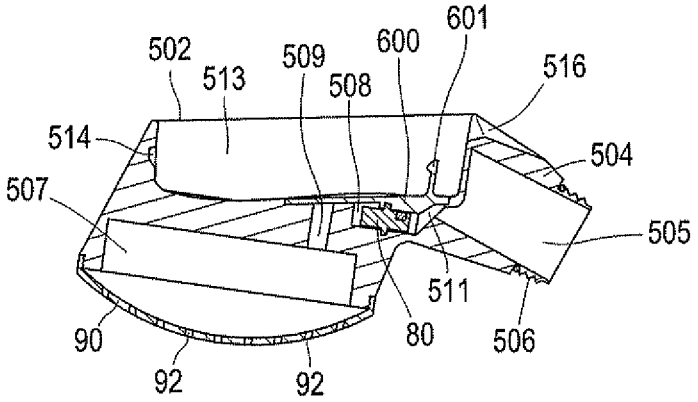
FIG. 38 is the fourth assembly view for a hand held shower head with filter replacing pre-alarm device in the third preferred exemplary embodiment of the present invention.
Figure 39:
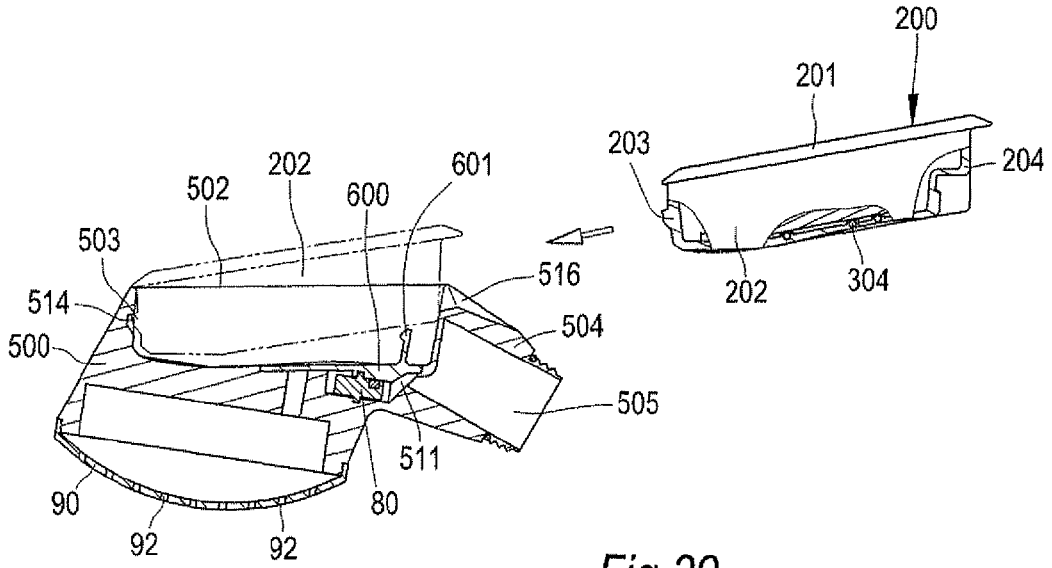
FIG. 39 is the first illustrative view showing the imbedding of an alerting pod into a shower head shell in the third preferred exemplary embodiment of the present invention.
Figure 40:
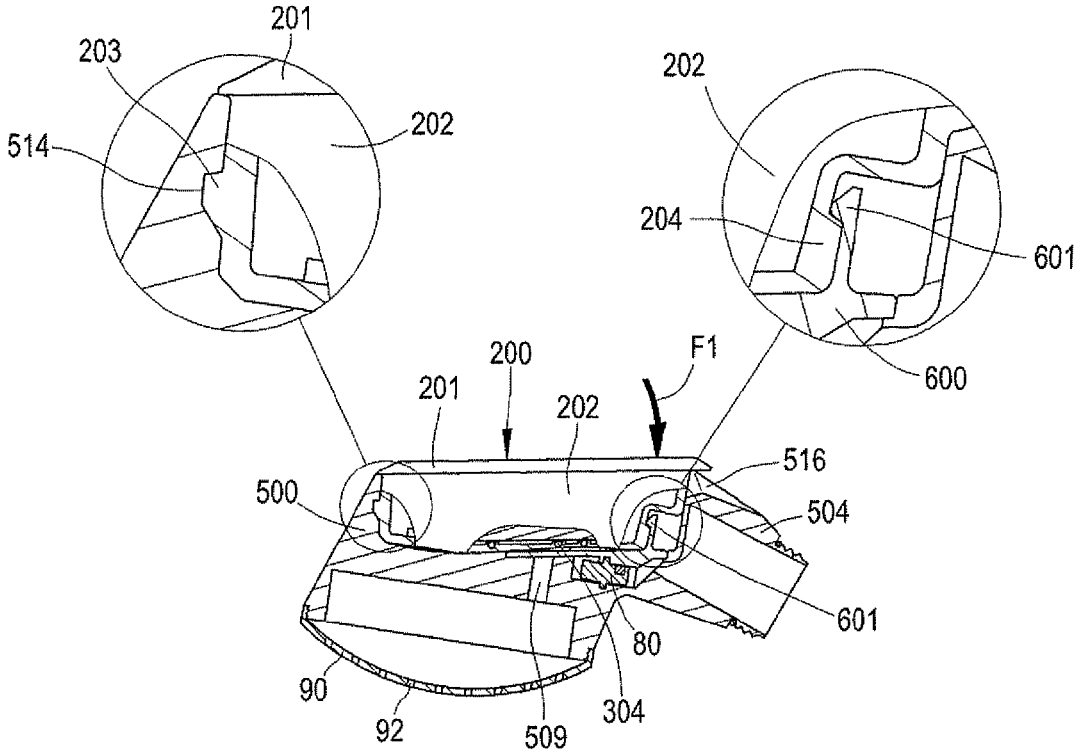
FIG. 40 is the second illustrative view showing the imbedding of an alerting pod into a shower head shell in the third preferred exemplary embodiment of the present invention.

For assembly steps in the third preferred exemplary embodiment of the present invention, please further refer to FIGS. 35 to 40.

a. Align the protruding hub 81 of the impeller 80 having magnetic element 82 in one vane with the impeller hub notch 510 of the impeller well 508 in the reverse side 102 of the shower head shell 500, then put the protruding hub 81 into the impeller hub notch 510 so that the magnetic element 82 of the impeller 80 faces toward the recess socket 513 of the shower head shell 500 (as shown in FIG. 35).

b. Attach the bottom surface of the internal panel 600 against the internal bottom wall of the recess socket 513 in the reverse side 502 of the shower head shell 500, then hermetically seal the rim of the internal panel 600 by high frequency fusion method to combine the internal panel 600 and shower head shell 500 into an integral body so that the top side of the impeller well 508 and top end of the water outlet 509 are simultaneously closely sealed with result that only the other lower end of the water outlet 509 is communicable with the receptacle 507. Thus, each of two protruding hub 81 of the impeller 80 is inserted into the impeller hub notch 510 of the impeller well 508 and the impeller hub notch 602 of the internal panel 600 respectively (as shown in FIG. 36).

c. Mate the hoop female threads 91 on the hood 90 with the rim male threads 520 on the obverse side 501 of the shower head shell 500 by screwing engagement (as shown in FIGS. 37 and 38).

d. Align and mate the terminal latching jut 203 in the mounting cavity 202 of the alerting pod 200 with the terminal latching nick 514 in the recess socket 513 of the reverse side 502 of the shower head shell 500 (as shown in FIG. 39). Then, thoroughly latch the snap latching nick 204 in the mounting cavity 202 with the snap latching jut 601 of the internal panel 600 (as right upper enlarged view shown in FIG. 40) by forcibly applying downward force F1 over the transparent lid 201 so that the terminal latching jut 203 in the mounting cavity 202 also fully latches with the terminal latching nick 514 in the recess socket 513 simultaneously (as left upper enlarged view shown in FIG. 40) to complete the assembly for the alerting pod 200 and shower head shell 500. Thus the overall assembly steps in the third preferred exemplary embodiment of the present invention are finished.

For operation mode in the third preferred exemplary embodiment of the present invention, please further refer to FIGS. 41 and 42.

Once the shower head is hooked up, the tap water enters into the impeller well 508 orderly via the handle filter 60, the water entry 505 in the handle butt 504, and the water inlet channel 511 to drive the impeller 80 rotate. Then, the tap water in the impeller well 508 flows out of the receptacle 507 in the shower head shell 500 orderly via the water outlet channel 512 and the water outlet 509 (as shown in FIG. 42). Finally, the tap water is jetted out of the water spray holes 92 in the hood 90 (as shown in FIG. 41). Wherein, for each rotation of the impeller 80 driven by the running water, the magnetic element 82 thereof simultaneously switches the magnetic reed switch 304 in the alerting pod 200 one time to induce a switching signal, which is relayed to the microprocessor 301 in the signal circuit device 300 for being processed to generate an accumulated data in certain preset interval for further transmitting to the LCD display circuit 302 for displaying related quantity of water flux thereon in accordance with following formula:

$$\text{Quantity of water flux}(Q)=\text{Cross sectional area}(A)\ \text{times Flow velocity}(V)$$

Thereby, a user of the shower head can get real time statistical data of the total filtered water quantity flowed through handle filter 60 by simply means of looking at the LCD display circuit 302 via the transparent lid 201 of the alerting pod 200. Once the total filtered water quantity flowed through handle filter 60 reaches (or near reaches) a predetermined critical value for the rated service life time of the specific handle filter 60, the microprocessor 301 will send a alerting signal with current data of the total filtered water quantity to the LCD display circuit 302 for reminding the user to notice that it is the time to replace the handle filter 60 timely to assure good quality of the handle filter 60 and filtered water thereby. Therefore, the user can avoid the harmful consequences to the health caused by the unclean water incurred by missing the replacement time and still continuously use the ineffective handle filter 60.

In conclusion of the disclosure heretofore, the present invention originates a novel contrivance that the a recess socket 113 is created in the reverse side 102 of the shower head shell 100, and a detachable alerting pod 200 with an internal signal circuit device 300 is independently created so that the alerting pod 200 can be either inserted into the recess socket 113 in the reverse side 102 of the shower head shell 100 for normal measuring and alerting function or detached off the recess socket 113 for battery recharging operation. Thereby, not only the shower head shell 100 can be adequately powered but also the alerting pod 200 can be separated out of the shower head shell 100 for recharging operation in isolated manner so that the issues happened in the conventional "hand held shower head with filter replacing pre-alarm device" are completely solved that the entire shower head shell 100 is unnecessary to discarded and replaced even the DC power supply in the signal circuit device 300 is running out. Thus, it not only saves resource waste but also conserves economical expense incurred by frequent replacement of the shower head. Therefore, the present invention meets criterion of patentability because it has extreme value of industrial application in addition to the novelty thereof inherently. Accordingly, we submit the patent application in accordance with related patent laws.

What is claimed is:

1. A hand held shower head with filter replacing pre-alarm device comprises a shower head shell, a handle filter, an internal lid, an impeller, a hood, a detachable alerting pod and a signal circuit device, wherein:

said shower head shell, which is a plastic hollow casing extruded into unitary piece having a mantle encompassed an obverse side with a set of rim male threads and a reverse side as an integral body, has a handle butt with a set of tubular threads formed on the tapered peripheral thereof, a hollow water entry created in the handle butt, a receptacle inwardly created into the obverse side, a water exit bore base and an impeller well with an impeller hub notch further inwardly created into internal bottom of the receptacle, and a water inlet channel created to communicate between the hollow water entry in the handle butt and the adjacent side of the impeller well while a water outlet channel created to communicate between the water exit bore base and the other side of the impeller well;

said handle filter is a filter cartridge disposed in a detachable handle with a set of female threads formed in jointing end section thereof to be mated with the set of tubular threads of the handle butt;

said internal lid, which is a planiform disk tightly attached on the bottom side of the receptacle in the shower head shell, has an inward surface facing toward the obverse side of the shower head shell, an impeller hub notch created therein to correspond with the impeller hub notch of the impeller well, a water outlet created therein to correspond with the water exit bore base of the receptacle in the shower head shell, and a plurality of screw holes peripherally created the marginal rim thereof such that the screw holes spread around the impeller hub notch and water outlet;

said impeller, which is a cylindrical profile body with plural curved vanes equivalently extending radically, has two central protruding hubs being coaxially disposed at top side and bottom side thereof respectively, and a magnetic element embedded in the top cut of one vane such that the impeller is freely rotatable in the impeller well by means of two central protruding hubs being mated with the impeller hub notch of the impeller well and the impeller hub notch of the internal lid respectively; and said hood, which is a plastic disk extruded into unitary piece, has a hoop female threads created around the bottom rim thereof and a plurality of water spray holes spread over the surface thereof so that the hoop female threads can mate with the rim male threads on the obverse side of the shower head shell by screwing engagement; wherein, the feature of the present invention lies in following characteristic parts:

said shower head shell has a round recess socket inwardly created into the reverse side to be having the detachable alerting pod embedded therein, and a terminal latching nick created in the distal internal wall of the recess socket while a snap latching jut created in the proximal internal wall of the recess socket;

said alerting pod, which is a plastic capsule made by a plastic transparent lid and a plastic mounting cavity via high frequency fusion method into a hermetically watertight integral body to accommodate the signal circuit device therein, has a terminal latching jut created on the heading rim thereof while a snap latching nick created on the rear rim thereof, two passive recharging electrodes firmly inset internal bottom wall of the mounting cavity with each one individual end of the two passive recharging electrodes protruding out of the mounting cavity; and said signal circuit device includes a microprocessor, a LCD display circuit electrically connected to the microprocessor with its location near the transparent lid, a rechargeable battery electrically connected to the microprocessor, and a magnetic reed switch securely inset on the internal bottom side of the mounting cavity such that the rechargeable battery is connected with the passive recharging electrode of the alerting pod via a pair of wires.

2. The hand held shower head with filter replacing prealarm device is claimed and recited in claim 1, wherein a finger guiding groove is further created into the top surface of the handle butt abutting the rim of the reverse side.

3. The hand held shower head with filter replacing prealarm device is claimed and recited in claim 1, wherein said rechargeable battery in the alerting pod is either nickel-chromium battery or lithium battery.

4. The hand held shower head with filter replacing prealarm device is claimed and recited in claim 1, wherein said magnetic reed switch in the alerting pod is replaced by Hall-effect component.

5. The hand held shower head with filter replacing prealarm device is claimed and recited in claim 1 further comprises a battery recharging mount including a battery recharging cavity with a pair of active recharging electrodes, which will securely contact the corresponding pair protruding ends of the passive recharging electrodes in the mounting cavity of the alerting pod for performing suitably recharging operation to the rechargeable battery in the alerting pod.

6. The hand held shower head with filter replacing prealarm device is claimed and recited in claim 1, wherein said internal lid, which is adapted into a plastic planiform disk extruded into unitary piece such that adapted internal lid combines the shower head shell as an integral body via high frequency fusion method after it is tightly attached on the bottom side of the receptacle in the shower head shell, comprises an inward surface with a impeller hub notch and a water outlet therein, wherein the impeller hub notch is to correspond with the impeller hub notch of the impeller well while the water outlet is to correspond with the water exit bore base of the receptacle in the shower head shell.

7. A hand held shower head with filter replacing pre-alarm device comprises a shower head shell, a handle filter, an internal panel, an impeller, a hood, a detachable alerting pod and a signal circuit device, wherein:

said shower head shell, which is a plastic hollow casing extruded into unitary piece having a mantle encompassed an obverse side with a set of rim male threads and a reverse side as an integral body, has a handle butt with a set of tubular threads formed on the tapered peripheral thereof, a hollow water entry created in the handle butt, a receptacle inwardly created into the obverse side, and a round recess socket inwardly created into the reverse side to be having the detachable alerting pod embedded therein such that a terminal latching nick is created in the distal internal wall of the recess socket while an impeller well with an impeller hub notch and a water outlet are respectively created into the proximal internal bottom wall of the recess socket near the hollow water entry of the handle butt, as well as a water inlet channel created to communicate between the hollow water entry in the handle butt and the adjacent side of the impeller well while a water outlet channel is created to communicate between the water outlet and the other side of the impeller well, wherein the water outlet is communicable with the receptacle; said shower head shell, which is a plastic hollow casing extruded into unitary piece having a mantle encompassed an obverse side with a set of rim male threads and a reverse side as an integral body, has a handle butt with a set of tubular threads formed on the tapered peripheral thereof, a hollow water entry created in the handle butt, a receptacle inwardly created into the obverse side, and a round recess socket inwardly created into the reverse side to be having the detachable alerting pod embedded therein such that a terminal latching nick is created in the distal internal wall of the recess socket while an impeller well with an impeller hub notch and a water outlet are respectively created into the proximal internal bottom wall of the recess socket near the hollow water entry of the handle butt, as well as a water inlet channel created to communicate between the hollow water entry in the handle butt and the adjacent side of the impeller well while a water outlet channel created to communicate between the water outlet and the other side of the impeller well, wherein the water outlet is communicable with the receptacle;

said handle filter is a filter cartridge disposed in a detachable handle with a set of female threads formed in jointing end section thereof to be mated with the set of tubular threads of the handle butt;

said internal panel, which is a plastic planiform disk extruded into unitary piece, has a snap latching jut created on the top surface thereof and an impeller hub notch created in the bottom surface thereof, functions to block the top opening of the impeller well in the round recess socket and top opening of the water outlet in blind manner with result that only the lower end opening of the water outlet is communicable to the receptacle when the bottom surface of the internal panel closely attaches and seals the upper internal bottom surface of the round recess socket in the reverse side of the shower head shell by high frequency fusion method such that both of the internal panel combines with the shower head shell as an integral body;

said impeller, which is a cylindrical profile body with plural curved vanes equivalently extending radically, has two central protruding hubs being coaxially disposed at top side and bottom side thereof respectively, and a magnetic element embedded in the top cut of one vane such that the impeller is freely rotatable in the impeller well by means of two central protruding hubs being mated with the impeller hub notch of the impeller well and the impeller hub notch of the internal panel respectively;

said hood, which is a plastic disk extruded into unitary piece, has a hoop female threads created around the bottom rim thereof and a plurality of water spray holes spread over the surface thereof so that the hoop female threads can mate with the rim male threads on the obverse side of the shower head shell by screwing engagement while the water spray holes enable the water in the receptacle on the obverse side of the shower head shell to jet out;

said alerting pod, which is a plastic capsule made by a plastic transparent lid and a plastic mounting cavity via high frequency fusion method into a hermetically watertight integral body to be embedded into the recess socket of the reverse side in the shower head shell for accommodating the signal circuit device therein, has a terminal latching jut created on the heading rim thereof while a snap latching nick created on the rear rim thereof, and two passive recharging electrodes firmly inset internal bottom wall of the mounting cavity with each one individual end of two passive recharging electrodes protruding out of the mounting cavity; and said signal circuit device, which is contained in the alerting pod, includes a microprocessor, a LCD display circuit electrically connected to the microprocessor with its location near the transparent lid, a rechargeable battery electrically connected to the microprocessor, and a magnetic reed switch securely inset on the internal bottom side of the mounting cavity such that the rechargeable battery is connected with the passive recharging electrode of the alerting pod via a pair of electric wires.

8. The hand held shower head with filter replacing prealarm device is claimed and recited in claim 7, wherein a finger guiding groove is further created into the top surface of the handle butt abutting the rim of the reverse side.

9. The hand held shower head with filter replacing prealarm device is claimed and recited in claim 7, wherein said rechargeable battery in the alerting pod is either nickel-chromium battery or lithium battery.

10. The hand held shower head with filter replacing prealarm device is claimed and recited in claim 7, wherein said magnetic reed switch in the alerting pod is replaced by Hall-effect component.

11. The hand held shower head with filter replacing prealarm device is claimed and recited in claim 7, which further comprises a battery recharging mount including a battery recharging cavity with profile thereof being similar to but slightly bigger than the profile of the mounting cavity in the alerting pod to completely accommodate the mounting cavity therein for performing suitably recharging operation to the rechargeable battery in the alerting pod.

* * * * *